US008831488B2

(12) United States Patent
Kobayashi et al.

(10) Patent No.: US 8,831,488 B2
(45) Date of Patent: Sep. 9, 2014

(54) IMAGE FORMING APPARATUS AND CONTROLLING METHOD THEREFOR

(75) Inventors: Masaya Kobayashi, Yokohama (JP); Isao Hayashi, Kawasaki (JP); Masaaki Naoi, Yokosuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 147 days.

(21) Appl. No.: 13/477,359

(22) Filed: May 22, 2012

(65) Prior Publication Data

US 2012/0301168 A1 Nov. 29, 2012

(30) Foreign Application Priority Data

May 23, 2011 (JP) ..... 2011-114804

(51) Int. Cl.
*G03G 15/01* (2006.01)
*G03G 15/16* (2006.01)
*G03G 15/00* (2006.01)

(52) U.S. Cl.
CPC ..... *G03G 15/0131* (2013.01); *G03G 15/1605* (2013.01); *G03G 2215/0158* (2013.01); *G03G 15/5058* (2013.01)
USPC ..... 399/301; 399/154; 430/48

(58) Field of Classification Search
CPC ... G03G 13/18; G03G 15/14; G03G 15/0131; G03G 15/1605; G03G 2215/0158
USPC ..... 399/154, 301; 430/48
See application file for complete search history.

(56) References Cited

U.S. PATENT DOCUMENTS 8,064,810 B2 11/2011 Okumura et al.
2010/0209124 A1 * 8/2010 Mizutani et al. ..... 399/16

FOREIGN PATENT DOCUMENTS

JP 2004-279823 A 10/2004

* cited by examiner

*Primary Examiner* — David Gray
*Assistant Examiner* — Thomas Giampaolo, II
(74) *Attorney, Agent, or Firm* — Fitzpatrick, Cella, Harper & Scinto

(57) ABSTRACT

An image forming apparatus includes a first station including a first photosensitive drum, a second station including a second photosensitive drum, and an intermediate transfer member for receiving the first toner image from the first drum and the second toner image from the second drum sequentially. In addition, a first sensor detects a first index image on the intermediate transfer member, and a second sensor detects a second index image on the second drum. A controller controls a peripheral speed of the second drum, and an executing device executes a test mode using a first test inclined index image and a second test inclined index image. The controller controls image forming conditions for the first and second index images in accordance with outputs of the first and second sensors in the test mode.

19 Claims, 19 Drawing Sheets

(a)

(b)

IMAGE FORMING APPARATUS AND CONTROLLING METHOD THEREFOR

FIELD OF THE INVENTION AND RELATED ART

The present invention relates to an image forming apparatus such as a copying machine, a printer, a facsimile machine, a multifunctional machine capable of performing as one or more of the preceding apparatus, etc. It also relates to a method for controlling an image forming apparatus.

There have been proposed various electrophotographic color image forming apparatuses. For high speed operation, some of them are provided with multiple image formation stations. They are color image forming apparatuses of the so-called tandem type. More concretely, they sequentially transfer yellow (Y), magenta (M), cyan (C) and black (Bk) developer (toner) images onto their intermediary transfer belt or a sheet of recording medium on their recording medium conveyance belt.

A color image forming apparatus of the tandem type, which is provided with multiple image formation stations for higher operational speed suffers from the following problem. That is, it suffers from color deviation. That is, its multiple image bearing members and/or intermediary transfer belt become unstable in speed because of mechanical imprecision or the like, which in turn makes the multiple image formation stations different in the positional relationship between the image on an image bearing member, and the area of the intermediary transfer belt, onto which the image is transferred. Therefore, the multiple monochromatic developer images, different in color, fail to precisely align as they are sequentially transferred in layers onto the intermediary transfer belt. There have been proposed various methods for minimizing this color deviation. Generally speaking, most of them form multiple marks, different in color, on an intermediary transfer belt or recording medium as soon as an image forming apparatus is turned on, or for every preset number of sheets of recording medium. Then, they detect the amount of color deviation, and change each image formation station in exposure timing based on the detected amount of color deviation.

Japanese Laid-open Patent Application 2004-279823 discloses one of the abovementioned methods. According to this application, electrostatic latent images are formed as the color deviation detection marks, and an image forming apparatus is corrected in color deviation using the electrostatic latent marks. FIG. 23 is a schematic drawing for describing how an image forming apparatus is corrected in color deviation by the method disclosed in the abovementioned patent application. To describe simply, toner is not adhered to an electrostatic latent image 30 formed on the peripheral surface of an image bearing member 31 by a developing section 34. Instead, the electrostatic latent image itself is transferred onto a recording medium conveyance member 32, such as a recording medium conveyance belt, forming thereby electrostatic latent marks on the recording medium conveyance member 32. More concretely, the opposite surface of the recording medium conveyance member 32 from the image bearing member 31 is charged by a transfer section 33, to the opposite polarity from the charge given to the peripheral surface of the image bearing member 31, whereby the electrostatic latent image is transferred onto the recording medium conveyance member 32.

As a result, electrostatic latent marks 45, 46, 47 and 48 are formed on the recording medium conveyance member 32; the number of electrostatic latent marks is optional (preset). Then, a non-contact potentiometer 49 (surface potentiometer) is used to measure the amount of potential of each of electrostatic latent marks to detect the position of the marks on the recording medium conveyance member 32, based on the changes in the potential of the marks. Then, the detected position of the electrostatic latent marks is used to prevent the image forming apparatus from forming an image which suffers from color deviation. However, in order to detect the "electrostatic latent mark" of the electrostatic latent image on the recording medium conveyance member 32 with the use of a surface potentiometer, the latent mark has to be no less than roughly 5 mm in diameter. Therefore, this method is not suitable for highly precisely aligning in layers multiple monochromatic color images which are different in color.

Even if the positional relationship between a sensor for detecting an electrostatic latent mark and the electrostatic latent marks formed on the image bearing member and/or recording medium conveyance member of a color image forming apparatus is perfect when the apparatus is brand-new, the positional relationship sometimes changes due to the changes which occur to the apparatus with the elapse of time, impacts to which the apparatus is subjected, adhesion of foreign substances, and the like. As the positional relationship changes, the sensor reduces in output, which results in increase in error in the detection of an electrostatic latent mark, or sometimes makes it impossible to detect the electrostatic latent mark. It is possible to adjust (readjust) the sensor in position and/or attitude according to the amount of changes in the positional relationship between the sensor and an electrostatic latent mark. However, the mechanism for adjusting the sensor in position and/or attitude is complicated, and also, it takes a substantial length of time to adjust the sensor in position and/or attitude, which results in cost increase.

SUMMARY OF THE INVENTION

According to an aspect of the present invention, there is provided an image forming apparatus comprising a first image forming station including a first photosensitive member, a first electrostatic image forming device configured to form an electrostatic image on said first photosensitive member and a first developing device configured to develop the electrostatic image on said first photosensitive member to form a first toner image with first color toner; a second image forming station including a second photosensitive member, a second electrostatic image forming device configured to form an electrostatic image on said second photosensitive member and a second developing device configured to develop the electrostatic image on said second photosensitive member to form a second toner image with second color toner of which color is different from color of the first color toner; an intermediate transfer member configured to receive the first toner image from said first photosensitive member and the second toner image from said second photosensitive member sequentially in this order so as to superimpose the second toner image on the first toner image; a first sensor configured to detect a first index electrostatic image, on said intermediate transfer member, formed by said first electrostatic image forming device and transferred from said first photosensitive member; a second sensor configured to detect a second index electrostatic image on said second photosensitive member formed by said second electrostatic image forming device; a controlling device configured to control a peripheral speed of said second photosensitive member so that the second index electrostatic image is superimposed on the first index electrostatic image at a transfer position where the second toner image is transferred from said second photosensitive member to said intermediate transfer member, in accordance with detection result of said first sensor and detection result of said second sensor; and an executing device configured to execute a test mode in which a first test index electrostatic image which is inclined relative to a moving direction of said first photosensitive member is formed on said first photosensitive member and then the first test index electrostatic image transferred on said intermediate transfer member from said first photosensitive member is detected by said first sensor, and a second test index electrostatic image which is inclined relative to a moving direction of said second photosensitive member is formed on said second photosensitive member and then the second test index electrostatic image is detected by said second sensor; wherein said controlling device controls an electrostatic image forming condition for the first index electrostatic image in accordance with detection result of said first sensor in the test mode, and an electrostatic image forming condition for the second index electrostatic image in accordance with detection result of said second sensor in the test mode.

According to another aspect of the present invention, there is provided a controlling method for an image forming apparatus including, a first image forming station including a first photosensitive member, a first electrostatic image forming device configured to form an electrostatic image on said first photosensitive member and a first developing device configured to develop the electrostatic image on said first photosensitive member to form a first toner image with first color toner; a second image forming station including a second photosensitive member, a second electrostatic image forming device configured to form an electrostatic image on said second photosensitive member and a second developing device configured to develop the electrostatic image on said second photosensitive member to form a second toner image with second color toner of which color is different from color of the first color toner; an intermediate transfer member configured to be transferred the first toner image from said first photosensitive member and the second toner image from said second photosensitive member sequentially in this order so as to superimpose the second toner image on the first toner image; a first sensor configured to detect a first index electrostatic image, on said intermediate transfer member, formed by said first electrostatic image forming device and transferred from said first photosensitive member; and a second sensor configured to detect a second index electrostatic image on said second photosensitive member formed by said second electrostatic image forming device; a controlling device configured to control a peripheral speed of said second photosensitive member so that the second index electrostatic image is superimposed on the first index electrostatic image at a transfer position where the second toner image is transferred from said second photosensitive member to said intermediate transfer member, in accordance with detection result of said first sensor and detection result of said second sensor, said controlling method comprising:

a first step of forming a first test index electrostatic image, on said first photosensitive member, which is inclined relative to a moving direction of said first photosensitive member; a second step of transferring the first test index electrostatic image from said first photosensitive member to said intermediate transfer member; a third step of detecting the first index electrostatic image on said intermediate transfer member by said first sensor; a fourth step of forming a second test index electrostatic image, on said second photosensitive member, which is inclined relative to a moving direction of said second photosensitive member; a fifth step of detecting the second test index electrostatic image on said second photosensitive member by said second sensor; and a sixth step of controlling an electrostatic image forming condition for the first index electrostatic image in accordance with detection result of said first sensor, and an electrostatic image forming condition for the second index electrostatic image in accordance with detection result of said second sensor.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 17(*b*) is a schematic drawing which shows how the latent mark sensor shown in FIG. 17(*a*) is positioned relative to the electrostatic latent mark on the image bearing member to read (detect) the mark.

FIG. 18(*b*) also is a sectional drawing of the latent mark sensor and the portion of the peripheral surface of the photosensitive drum 4 adjacent to the sensor, and shows that the area of contact between the sensor and the photosensitive drum has changed in position, and therefore, the detection wires 20C was selected as the one which makes the sensor optimal in output.

DESCRIPTION OF THE PREFERRED EMBODIMENTS

[Embodiment 1]

(Image Forming Apparatus)

Figure 5:
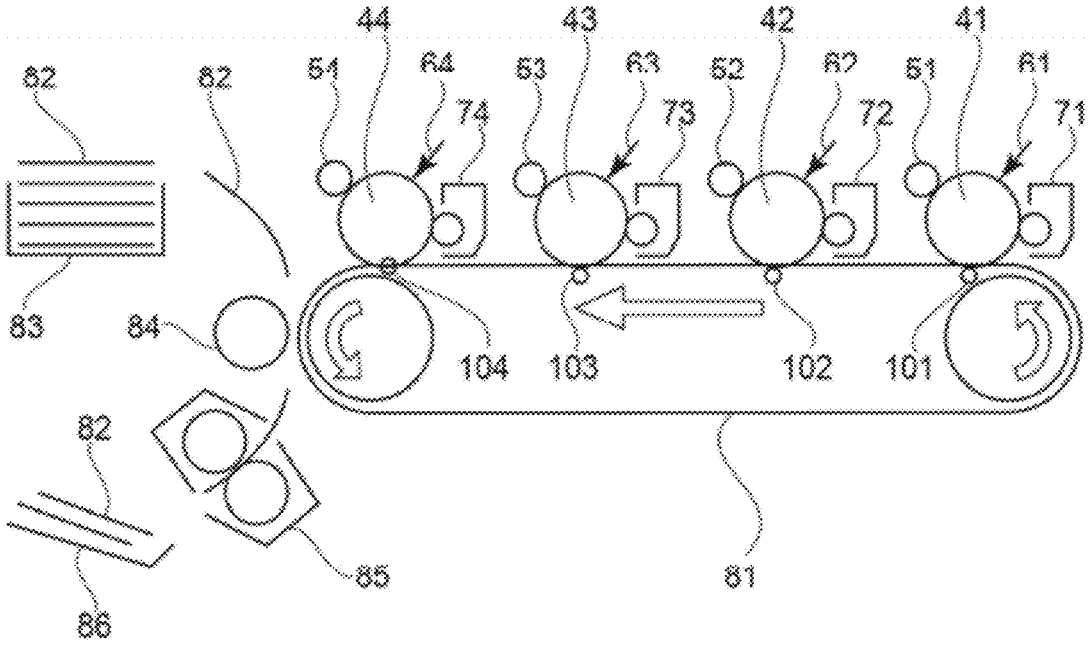
FIG. 5 is a schematic sectional view of the electrophotographic color image forming apparatus in the first embodiment of the present invention.

FIG. 5 is a schematic sectional view of the electrophotographic color image forming apparatus in this embodiment, which is of the so-called tandem type and employs an intermediary transfer belt. It shows the general structure of the apparatus. The image forming apparatus has four image formation stations which form yellow (Y), magenta (M), cyan (C) and black (Bk) monochromatic images, one for one, with the use of developer. The four stations are aligned in parallel in the moving direction of the intermediary transfer belt 81 (intermediary transferring member) along the belt 81.

The four image formation stations have rotatable photosensitive members 41-44, which are image bearing members, and are in the form of a drum. On the image formation area of the photosensitive member 41, a monochromatic yellow (Y) image is formed of yellow developer (toner). On the image formation area of the photosensitive member 42, a monochromatic magenta (M) image is formed of magenta developer (toner). On the image formation area of the photosensitive member 43, a monochromatic cyan (C) image is formed of cyan developer (toner). Further, on the image formation area of the photosensitive member 44, a monochromatic black (Bk) image is formed of black developer (toner).

Figure 1:
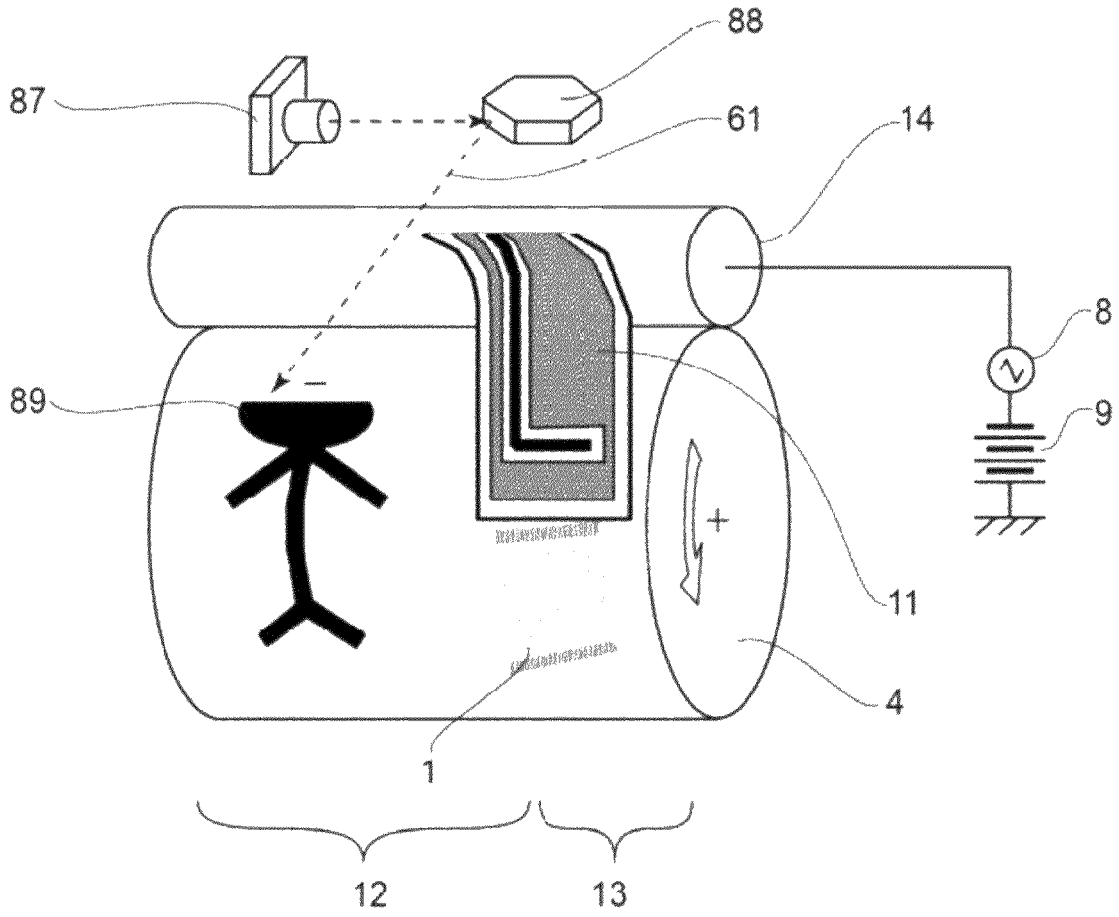
FIG. 1 is a schematic drawing for describing a structural arrangement for detecting multiple electrostatic latent marks, different in pattern, with the use of a sensor.

More concretely, the peripheral surface of each photosensitive drum 4 (41-44) is uniformly charged to a preset potential level (−500 V, for example) by a charge roller 51 (52, 53 or 54) as a charging device. Then, the uniformly charged area of the peripheral surface of the photosensitive drum 4 is exposed to a beam 61 (62, 63 or 64) of laser light emitted, while being modulated with image formation signals, from an exposing device made up of a light source 87, a polygon mirror 88, etc., (FIG. 1). As a result, each of the exposed points of the peripheral surface of the photosensitive drum 4 reduces in potential to −100 V, for example. Consequently, electrostatic latent images which correspond to yellow (Y), magenta (M), cyan (C) and black (Bk) colors, one for one, of which an image to be formed is made up, are effected on the peripheral surfaces of the photosensitive drums 41, 42, 43, and 44, respectively.

The electrostatic latent images on the photosensitive drums 41-44 are developed by the developing devices 71-74, into visible images (toner images) made up of yellow, magenta, cyan and black toners, respectively. Then, the four toner images, different in color, are sequentially transferred in layers (primary transfer) by primary transfer rollers 101-104 (transferring members), onto the intermediary transfer belt 81, which is movably in contact with the peripheral surface of each of the four photosensitive drums 41-44, in such a manner that as the toner images are layered on the intermediary transfer belt 81, they align in the direction perpendicular to the intermediary transfer belt 81. Thereafter, the layered four toner images, different in color, on the intermediary transfer belt 81 are transferred together (secondary transfer) by the secondary transfer roller 84, onto a sheet 82 of recording medium delivered from the sheet feeder cassette 83. Then, the toner images are fixed to the sheet 82 of recording medium by the fixing device 85. Then, the sheet 82 is discharged into the delivery tray 86 of the image forming apparatus.

(Color Deviation Prevention System which Uses Electrostatic Latent Marks (Scales))

The image forming apparatus can be controlled in the movement of its photosensitive drums 4*a*-4*d*, movement of the intermediary transfer belt 81, exposure timing, etc., by using a combination of electrostatic latent marks (scale) and a sensor (detecting means) for detecting the electrostatic latent marks. With the use of this combination, it is possible to highly precisely (no more than 0.1 mm, for example, in error) align the four toner images, different in color, as they are transferred in layers (secondary transfer) onto the intermediary transfer belt 81. Therefore, the combination can prevent the electrophotographic image forming apparatus from outputting images which suffer from color deviation (attributable to misalignment of monochromatic toner images different in color). Therefore, in the case of a system which corrects an electrophotographic image forming apparatus with the use of the above-mentioned combination, how precisely a sensor for detecting an electrostatic latent mark can detect the position of an electrostatic latent mark 1 in FIG. 1 (mark 1*b* in FIG. 6) is very important to prevent the electrophotographic image forming apparatus from outputting images which suffer from color deviation.

1) Electrostatic Latent Marks

Figure 6:
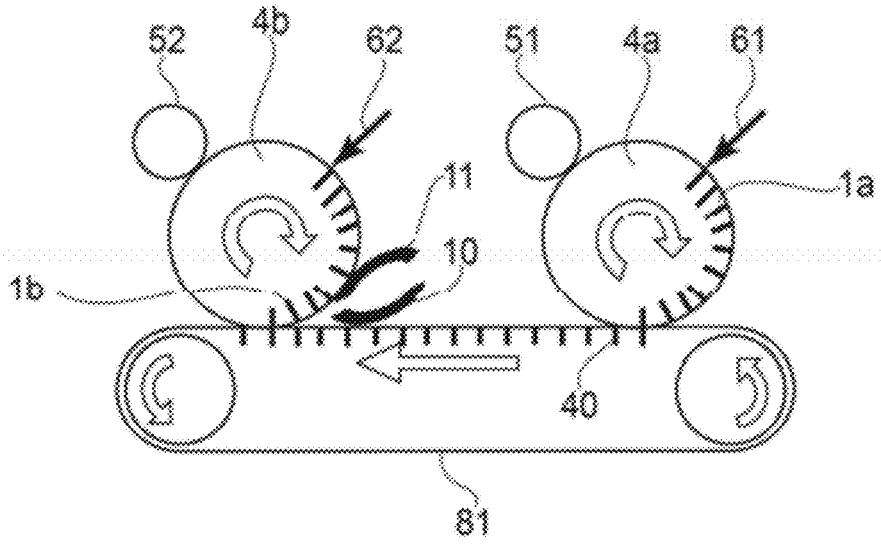
FIGS. 6(*a*) and 6(*b*) are schematic drawings of the color deviation reduction system which uses an electrostatic latent mark (scale).
Figure 6:
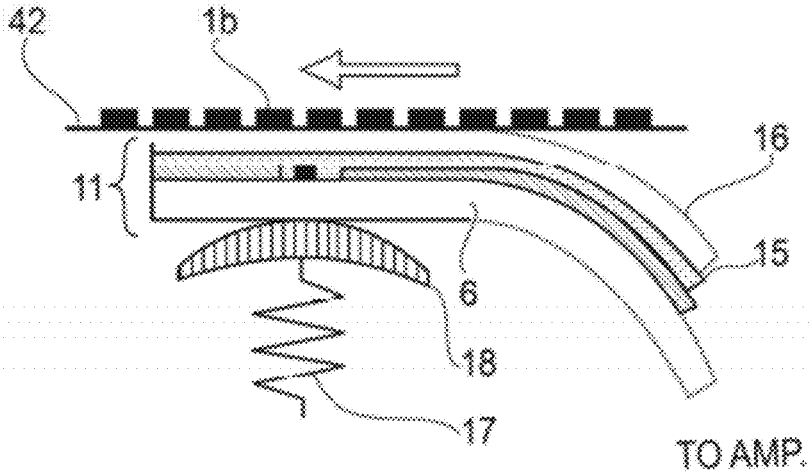

Referring to FIG. 6(*a*), multiple electrostatic latent marks 1*a*, which are linear and straight, are formed on the area 13 of the peripheral surface of the photosensitive drum 4*a*, which is outside the image formation area of the drum 4*a*, and multiple electrostatic latent marks 1*b*, which are linear and straight, are formed on the area 13 of the peripheral surface of the photosensitive drum 4*b*, which is outside the image formation area of the drum 4*b*. In terms of the direction which intersects with the moving direction of the photosensitive drum 4, this area 13 (FIG. 1) is next to the image formation area 12 of the peripheral surface of the photosensitive drum 4. In terms of the direction parallel to the moving direction of the peripheral surface of the photosensitive drum 4, the area 13 extends from the upstream side of the image formation area 12 to the downstream side of the image formation area 12.

As for the electrostatic latent marks for the belt 81, they are formed on the area of the belt 81, which is outside the image formation area of the intermediary transfer belt 81, in terms of the direction intersectional to the moving direction of the belt 81, with the use of the following method. That is, the electrostatic latent marks 1*a* formed on the most upstream drum 4*a* are transferred as electrostatic latent marks 40 onto the intermediary transfer belt 81, and become the second electrostatic latent marks, that is, the electrostatic latent marks for the belt 81. It is at the same time as when an image is transferred onto the intermediary transfer belt 81 by the primary transfer roller 101 (transferring member) that the electrostatic latent marks 1*a* are transferred onto the intermediary transfer belt 81 by the second transferring member. Incidentally, in this embodiment, the primary transfer roller 101 doubles as the member for transferring the electrostatic latent marks 1*a* onto the intermediary transfer belt 81. However, this embodiment is not intended to limit the present invention in scope in terms of the member for transferring the electrostatic latent image 1*a* onto the intermediary transfer belt 81. For example, the image forming apparatus may be provided with a member dedicated to the transfer of the electrostatic latent marks 1*a* onto the intermediary transfer belt 81.

Thus, the electrostatic latent marks 40 and developer (toner) image on the intermediary transfer belt 81 meet with the developer (toner) image and electrostatic latent marks 1*b* on the drum 4*b*, in the transfer station between the drum 4*b* and intermediary transfer belt 81.

2) Sensor for Detecting Electrostatic Latent Mark)

Figure 4:
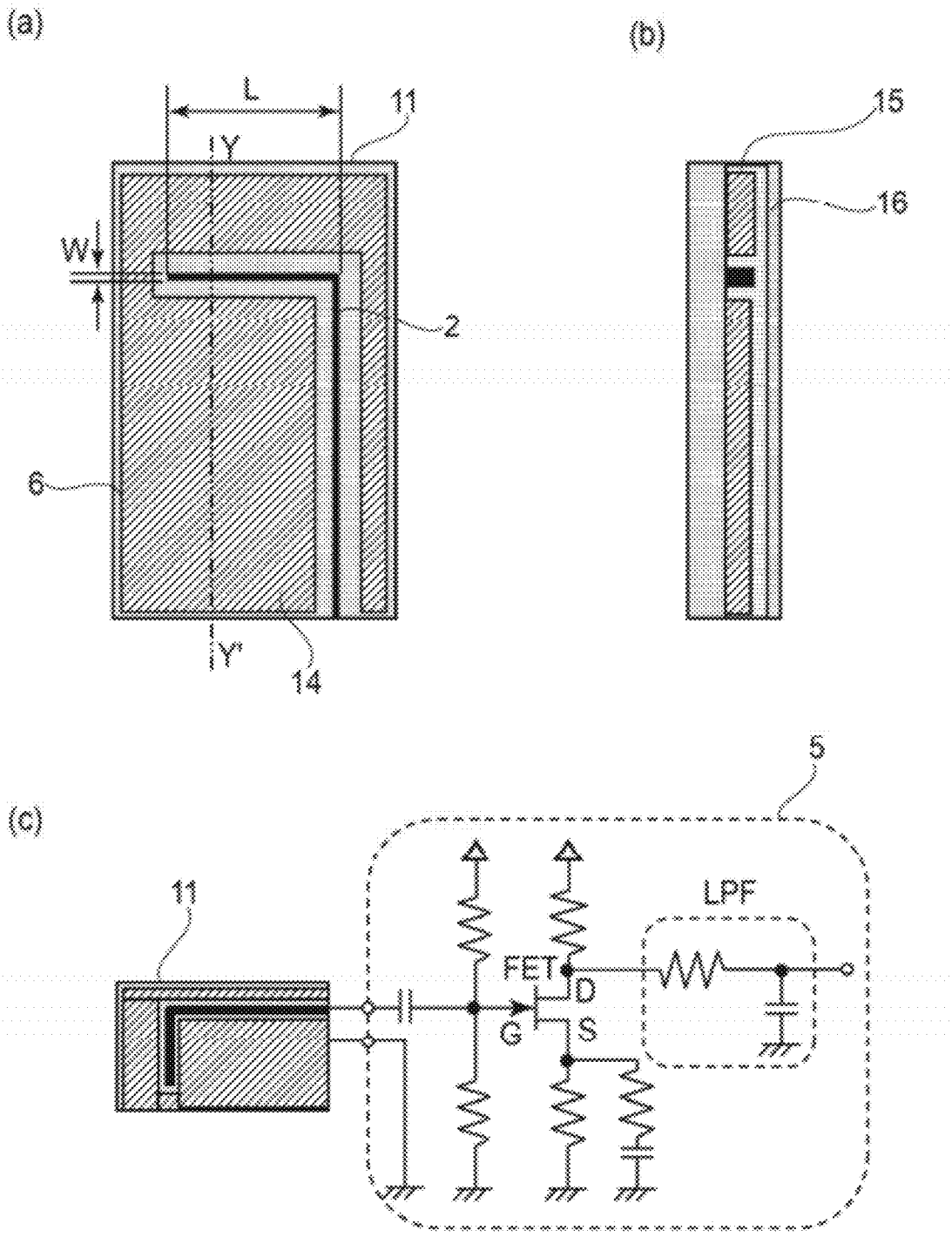
FIGS. 4(*a*)-4(*c*) are schematics of the sensor formed on a flexible substrate to detect an electrostatic latent mark.

The sensor 11 for the drum 4 is the first detecting means for detecting an electrostatic latent mark, and is for obtaining the information about the position of the electrostatic latent mark on the drum 4*b*. The sensor 10 (FIG. 6(*a*)) for the intermediary transfer belt 81 is the second detecting means for detecting an electrostatic latent mark, and is for obtaining the information about the position of the image on the intermediary transfer belt 81. The sensor 11 (first detecting means) for the drum, and the sensor 10 (second detecting means) for the intermediary transfer belt 81 coincide in position in terms of the direction perpendicular to the moving direction of the intermediary transfer belt 81. Referring to FIG. 4, the sensors 11 and 10 for the drum 4 and belt 81, respectively, are made up of a piece of flexible substrate 6 (which hereafter may be referred to simply as substrate 6) and an electrostatic latent mark detection wire 2.

FIG. 6(*b*) is an enlarged schematic sectional view of the portion of the sensor 11, by which the sensor 11 is kept pressed upon the image bearing member 4*b* by a combination of a spring 17 and a pressing member 18. The side of the sensor 11, which faces the image bearing member 4*b*, is covered with a sheet 16 of film which is thinner than the substrate 6. Therefore, it is possible for the sensor 11 to be placed as close as possible to the electrostatic latent mark 1*b* to make the sensor 11 as strong as possible in output signal. That is, the sensor 11 for the drum 4*b* is positioned so that it presses upon the peripheral surface of the drum 4*b*, near the area of contact between the drum 4*b* and intermediary transfer belt 81 as shown in FIG. 6(*b*). As for the sensor 10 for the intermediary transfer belt 81, it is positioned so that it presses upon the intermediary transfer belt 81, near the area of contact between the drum 4*b* and intermediary transfer belt 81 as shown in the drawing.

3) Principle Based on which Electrostatic Latent Mark is Detected

Figure 2:
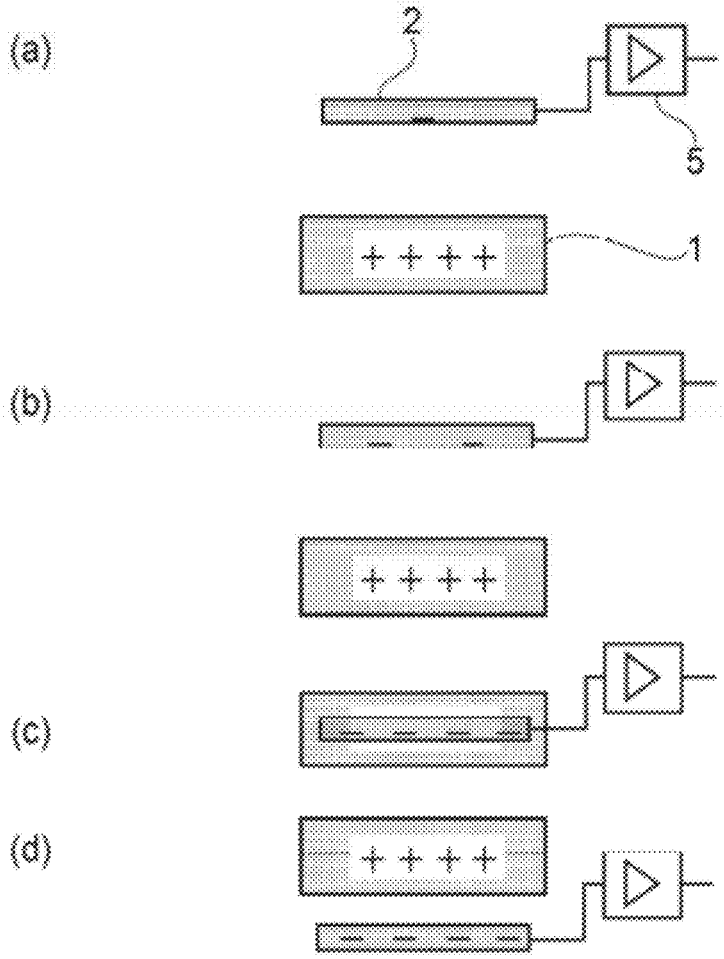
FIGS. 2(*a*)-2(*d*) are drawings for describing the principle based on which an electrostatic latent mark is detected.

Here, the principle based on which an electrostatic latent mark is detected by the sensors 10 and 11 is described. FIG. 2 is for describing how an electrostatic latent mark 1 is detected by the electrostatic latent mark detection wire 2 of the sensor 10 or 11. FIG. 2 shows only one of the electrostatic latent marks. The wire 2 is in connection to a detection signal amplification circuit 5. The electrostatic latent mark 1 is in the form of electrical potential, and the wire 2 is microscopically away (several micrometers—several tens of micrometers) from the peripheral surface of the drum 4. FIGS. 2(*a*), 2(*b*) and 2(*c*) represent the changes which occur to the positional relationship between the wire 2 and electrostatic latent mark 1, with the elapse of time.

While the peripheral surface of the photosensitive drum 4*b* moves, the distance between the wire 2 and the peripheral surface of the photosensitive drum 4*b* remains the same. In FIG. 2, the potential level of the electrostatic latent mark 1 is negative, which means that the adjacencies of the electrostatic latent mark 1 are −500 V in potential level, and the electrostatic latent mark 1 is −100 V in potential level. Thus, the potential level of the electrostatic latent mark 1 is positive relative to the potential level of its adjacencies. First, referring to FIG. 2(*a*), as the electrostatic latent mark 1 nears the wire 2, the free electrons in the electrical wiring between the wire 2 and amplification circuit 5 are attracted a little by the "positive" potential of the electrostatic latent mark 1.

Figure 3:
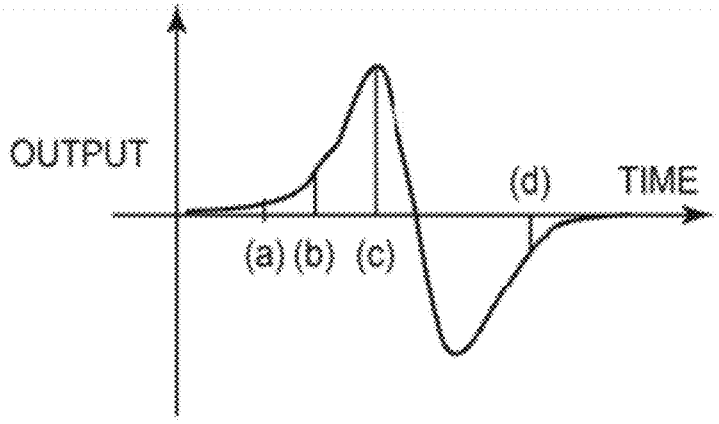
FIG. 3 is a graph which shows the relationship between the strength of the sensor output and elapsed time.

Next, referring to FIG. 2(*b*), as the electrostatic latent mark 1 comes closer to the wire 2 than when it is in FIG. 2(*a*), the number of the free electrons in the electrical wiring between the wire 2 and amplification circuit 5, which are attracted by the "positive" potential of the electrostatic latent mark 1 increases. Next, referring to FIG. 2(*c*), as the distance between the electrostatic latent mark 1 and wire 2 becomes smallest, the number of the electrons in the aforementioned electrical wiring become largest. Lastly, as the electrostatic latent mark 1 begins to move away from the wire 2 as shown in FIG. 2(*d*), the free electrons which were being attracted by the electrostatic latent mark 1 begin to return to where they come from. This movement (flow: induction current) of the free electrons can be detected by the amplification circuit 5 and be output as electrical signals which show the position of the electrostatic latent mark 1. FIG. 3 is a graph which shows the relationship between the strength of the output of the amplification circuit 5 and the time which elapsed between when the electrostatic latent mark 1 began to near the wire 2 and when the electrostatic latent mark 1 began to move away from the wire 2.

As the electrostatic latent mark 1 nears the wire 2, the amplification circuit 5 becomes stronger in output. Then, as the electrostatic latent mark 1 moves into where the wire 2 is on top of the electrostatic latent mark 1 (distance between electrostatic latent mark 1 and wire 2 is smallest), the induction current reduces to zero for a moment. Then, as the electrostatic latent mark 1 moves away from the wire 2, the output of the amplification circuit 5 becomes negative. Then, as the electrostatic latent mark 1 moves further away from the wire 2, the amplification circuit 5 gradually reduces in the strength of its output signal, reducing eventually to zero. This is the principle based on which the position of the electrostatic latent mark 1 can be detected.

FIG. 4 is a schematic drawing of an example of the actual electrostatic latent mark sensor; FIG. 4(*a*) is a schematic plan view of the sensor, and FIG. 2(*b*) is a schematic plan view of the sensor at a plane Y-Y' in FIG. 2(*a*). It is the horizontal portion of the wire 2 in FIG. 2(*a*) that plays the role of detecting the previously described electrostatic latent mark.

The vertical portion of the wire 2 in FIG. 4(*a*) plays the role of drawing out the electrical current which occurs as the wire 2 detects an electrostatic latent mark 1. As for the method for manufacturing the sensor, an electrode layer is formed on a piece 6 of flexible substrate (made of polyimide), and is etched into a pattern of a letter L by wet-etching. Then, a cover sheet 16 of polyimide film (15 μm in thickness) is applied to the surface of the sheet of polyimide film 16 and the L-shaped electrode thereon, with the application of a layer 15 (15 μm in thickness) of adhesive between the sheet 16 and the piece 6 of substrate. One of the ends of the wire 2 is in connection to a connector (unshown), through which it is in connected to the amplification circuit 5 as shown in FIG. 4(*c*).

An example of the amplification circuit 5 is the amplification circuit, shown in FIG. 4(*c*), which uses a FET. The electric current which flows through an antenna (wire 2) enters the amplification circuit 5 from the input side of the amplification circuit 5, and changes the gate voltage (G in FIG. 4(*c*)). As the gate voltage changes, the electric current between the source and drain (S and D in FIG. 4(*c*) changes. For example, as the electric current between the source S and drain D increases, the drain voltage reduces. That is, the electric current between the source S and drain D subtly changes in response to the change in the gate voltage, which in turn causes the drain voltage, that is, the output voltage, to change. The amplification factor (Vout/Vin) of the amplification circuit 5 structured as described is roughly 18 times (actually measured value).

Further, the output side of the amplification circuit 5 is in connection to a low-pass circuit which is 4420 Hz in cut-off frequency. The opposite side of the L-shaped wire 2 from the side which is in connection to the amplification circuit 5 functions as the wire 2 in FIG. 2. The sensor 11 is placed in contact with the peripheral surface of the drum 4*b* so that the polyimide film 16 which covers the flexible substrate 6 is placed in contact with the peripheral surface of the drum 4*b*. Thus, the distance between the peripheral surface of the drum 4*b* and wire 2 is the same as the thickness (several micrometers—several tens of micrometers) of the sheet 16 of polyimide film which covers the pattern on the flexible substrate 6.

(Surface Potential Level Detection by Electrostatic Latent Mark Sensor)

Figure 7:
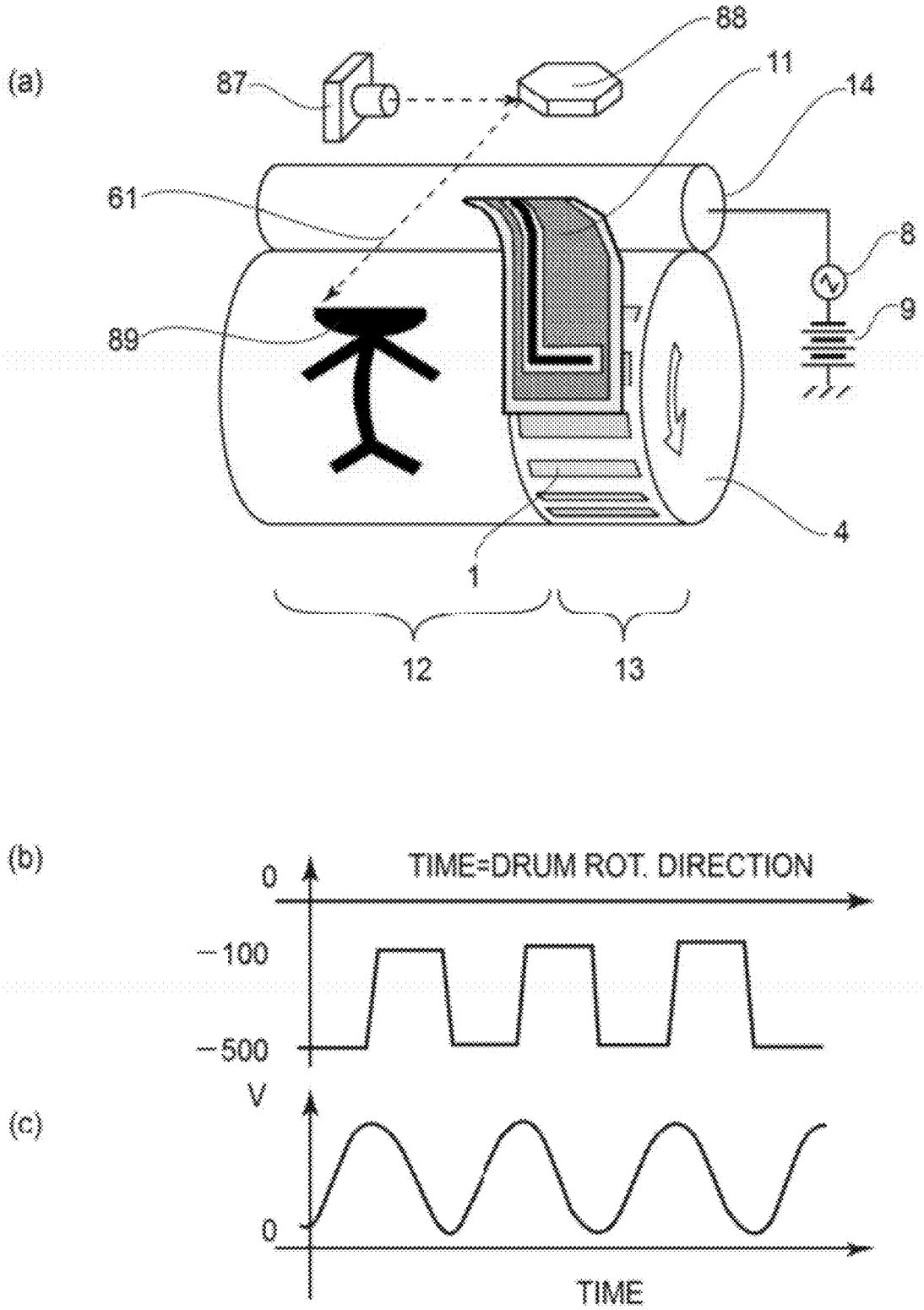
FIGS. 7(*a*)-7(*c*) are drawings for describing how the electrostatic latent marks on the drum are detected.

Next, the arrangement for detecting the electrostatic latent marks on the drum 4, which are linear, straight, and low in potential level, with the use of the electrostatic latent mark sensor is described. Referring to FIG. 7 which shows how the electrostatic latent marks 1 on the drum 4 are detected by the electrostatic latent mark sensor 11 when the positional relationship between the sensor 11 and electrostatic latent marks 1 on the drum 4 is optimal. The electrostatic latent marks 1 are drawn on the electrostatic latent mark formation area 13 of the peripheral surface of the photosensitive drum 4 at the same time as when an electrostatic latent image 89 is formed on the peripheral surface of the photosensitive drum 4 by the beam 16 of laser light. The sensor 11 is in contact with this electrostatic latent mark formation area 13 to detect the electrostatic latent marks 1. The potential level of the peripheral surface of the drum 4 is the same as that of the image formation area of the peripheral surface of the drum 4. Thus, as the latent image formation area of the peripheral surface of the drum 4 moves, the alternate absence and presence of the electrostatic latent mark 1 makes the potential level of the peripheral surface of the drum 4 change in the form of a rectangular wave as shown in FIG. 7(*b*).

Thus, as the surface potential of the electrostatic latent image formation area 13 is detected by the sensor 11, the relationship between the detected voltage and elapsed length of time becomes sinusoidal as shown in FIG. 7(*c*). All that is necessary to do in order to use this sinusoidal waveform as the means for correcting the image forming apparatus in color deviation is to differentiate the detected voltage with respect to elapsed time, and use the point which is steepest in angle. This method is desirable because it is small in the amount of error.

(Test Mode)

1) Formation of Electrostatic Latent Image Marks Different in Angle

In the test mode, in order to deal with the angle of the sensor 11 (detection wire 2) relative to the electrostatic latent mark, multiple electrostatic latent marks different in angle are drawn (formed) as the electrostatic latent marks for the test mode. Referring to FIG. 1, the peripheral surface of the photosensitive drum 4 is charged by a charge roller 14 to a preset potential level (−500 V, for example). To the charge roller 14, a combination of DC and AC voltages are applied from a combination of a DC power source 9 and an AC power source 8. The charged peripheral surface of the drum 4 is scanned (exposed) (line by line?) by the beam 61 of laser light emitted from a laser driver 87 while being modulated (turned on or off) based on the image formation data, and deflected by a polygon mirror, which is rotating at a high speed.

Exposed points of the charged area of the peripheral surface of the photosensitive drum 4 change in potential level (to −100 V, for example). Thus, the electrostatic latent image 89 is formed on the image formation area 12 of the drum 4, and electrostatic latent marks 1 are formed on the electrostatic latent mark formation area 13 of the drum 4.

2) Formation of Electrostatic Latent Marks Different in Angle

Electrostatic latent marks 1 different in angle are formed as electrostatic latent marks with pseudo angle by controlling a preset number of adjacent scanning lines in terms of the secondary scan direction, in exposure timing (expose to form electrostatic latent marks). For example, in the case of the angled electrostatic latent mark 1 shown in FIG. 12(*c*), first, the area of the peripheral surface of the photosensitive drum 4, which corresponds to the top-right portion of the electrostatic latent mark 1, is formed by controlling the exposing device in exposure timing while the device is scanning the peripheral surface of the photosensitive drum 4, which corresponds to the first scan line. Then, the area of the peripheral surface of the photosensitive drum 4, which corresponds to the bottom-left portion of the electrostatic latent mark 1 is formed by controlling the exposing device in exposure timing while the device is scanning the peripheral surface of the photosensitive drum 4, which corresponds to the second scan line in terms of the secondary scan direction.

With the exposing device being controlled in exposure timing as described above, a pseudo angled electrostatic latent mark, which is a combination of the above described top-right portion and bottom-left portion is formed; the pseudo angled electrostatic latent mark can be taken for an angled straight electrostatic latent mark. Similarly, the pseudo electrostatic latent mark in FIG. 12(*d*), which is greater in angle than the electrostatic latent mark in FIG. 12(*c*), is formed by using adjacent three scan lines. Further, the pseudo electrostatic latent mark in FIG. 12(*e*), which is greater in angle than the electrostatic latent mark in FIG. 12(*d*), is formed by using adjacent four scan lines.

Concerning the placement of the sensor 11 in contact with the peripheral surface of the photosensitive drum 4, since the photosensitive drum 4 is rotated, the sensor 11 is desired to be placed in such an attitude that its base portion is on the upstream side of the area of contact between the sensor 11 and the peripheral surface of the photosensitive drum 4. Conventionally, the electrostatic latent marks 1 to be detected by the sensor 11 are the same in angle (perpendicular to moving direction of peripheral surface of photosensitive drum 4). In this embodiment, however, multiple electrostatic latent marks different in angle are drawn to deal with the changes in the angle of the sensor 11.

3) Selection of Electrostatic Latent Mark which is Optimal in Angle

The combination of the sensor 11 and electrostatic latent mark 1, which makes largest the output of the amplification circuit 5, is selected. That is, the electrostatic latent mark 1, the angle of which relative to the sensor 1 is zero, is selected.

Next, how to optimize the detection signal in the test mode is described. The normal electrostatic latent marks are formed by moving the beam 61 of laser light in the thrust direction of the drum 4 (direction of rotational axis of drum 4). As the photosensitive drum 4 is rotated one full turn after the formation of the electrostatic latent marks on the peripheral surface of the photosensitive drum 4, the electrostatic latent marks are erased by the exposure during the next rotation of the photosensitive drum 4. The size of an electrostatic latent mark is affected by the resolution of the laser driver and the rotational speed of the photosensitive drum 4. For example, when the resolution is 600 dpi, the smallest width for an electrostatic latent mark is 42 μm (≈25,400 μm/600).

The less in width an electrostatic latent mark, the higher in resolution the electrostatic latent mark. However, the strength of the signal detected by the wire 2, which is W in width (FIG. 4), has to be taken into consideration. The detection signal is strongest when the angle of the wire 2 relative to an electrostatic latent mark is zero (when wire 2 is parallel to electrostatic latent mark), and as the angle of the wire 2 relative to an electrostatic latent mark increases, the detection signal reduces in strength. Since the sensor 11 detects the electrostatic latent marks while continuously sliding on the peripheral surface of the photosensitive drum 4, it is possible that the angle of the sensor 11 (wire 2) will be made greater than zero by vibrations, contaminants, and/or the like.

Figure 8:
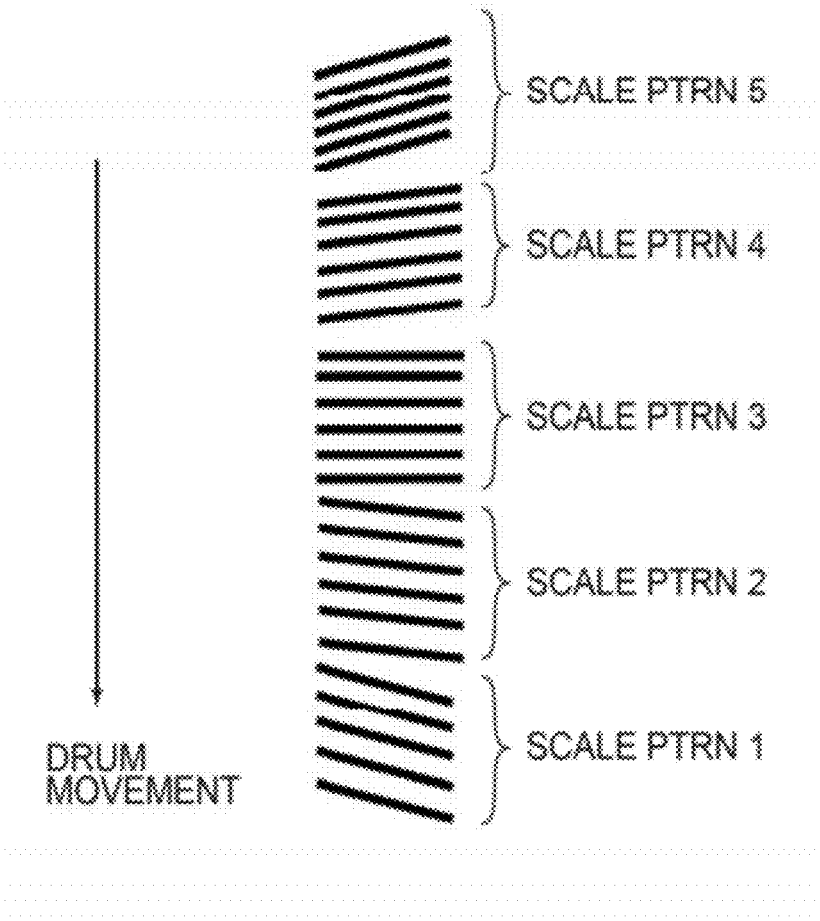
FIG. 8 is a schematic drawing of multiple sets of electrostatic latent marks, which are made different in latent mark angle to deal with the changes which occur to the angle of the electrostatic latent mark sensor.
Figure 11:
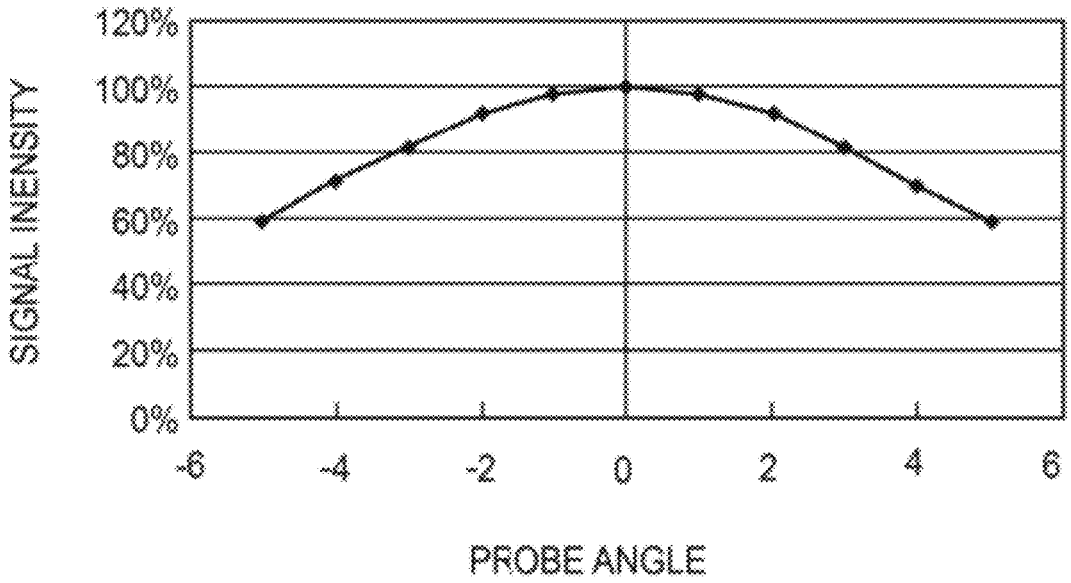
FIG. 11 is a graph which shows the changes which occur to the output of the electrostatic latent mark sensor as the positional relationship between the sensor and electrostatic latent mark changes.

As described above, in a case where the output from the sensor 11 becomes less in strength than a preset value, the sensor 11 can be increased in the strength of its output by drawing such electrostatic latent marks that are angled relative to the thrust direction of the drum 4 as shown in FIG. 8. FIG. 11 shows how the wire 2 was affected in output by the angle of the wire 2 relative to the thrust direction of the photosensitive drum 4 (which hereafter will be referred to simply as relative angle). In this case, the electrostatic latent marks were drawn at 600 dpi in resolution so that an electrostatic latent mark, the width of which was 169 μm (which is equivalent to four dots), and a space, which is the same in width as the electrostatic latent mark, alternately appear as the photosensitive drum 4 rotates.

Figure 14:
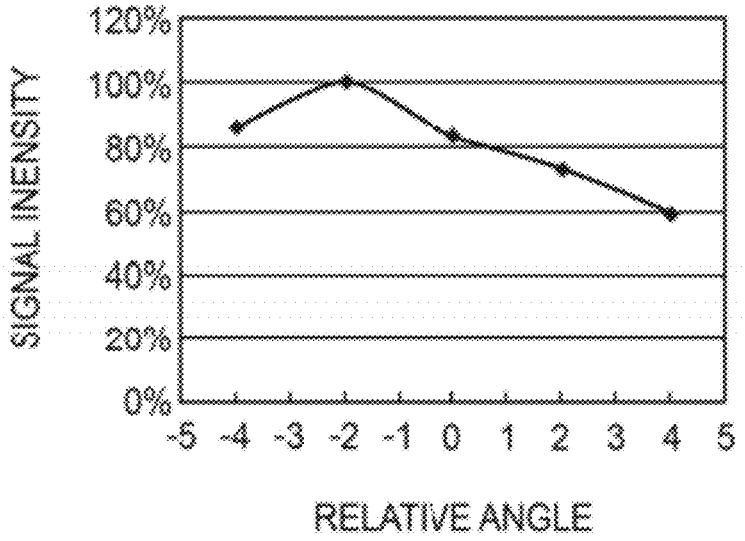
FIG. 14 is a graph which shows that the output of the latent mark sensor had a peak, and therefore, it is only once that the routine had to be performed to optimize the latent mark sensor in output.

The detection wire 2 was 10 μm in width W, and 2 mm in length L. The drum 4 was rotated at 140 mm/sec in peripheral velocity. In FIG. 14, the horizontal axis stands for the relative angle, and the vertical axis stands for the relative signal strength, assuming that the signal strength is 100% when the relative angle is zero. Where the relative angle is in a range of −2° to +2°, the signal strength remains to be no less than 90%. However, as the relative angle increases as large as 4°, the signal strength reduces to as low as 70%. Stating in reverse, as long as electrostatic latent marks are drawn so that the relative angle between the electrostatic latent marks and the detection wire 2 remains within the range of −2° to +2°, the signal strength remains to be no less than 90%, making it possible to reliably detect the electrostatic latent marks.

Figure 12:
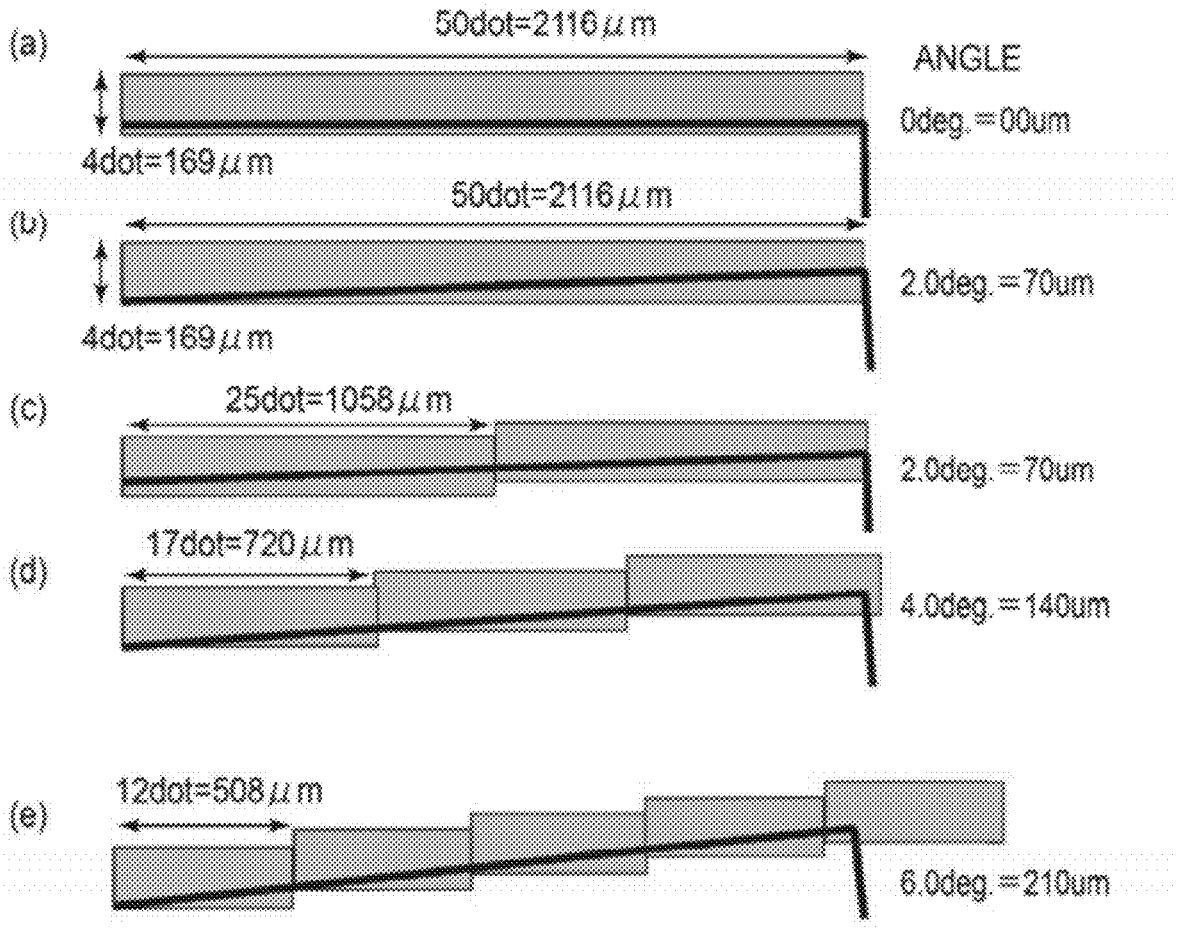
FIGS. 12(*a*)-12(*e*) are drawings of the electrostatic latent marks which were made different in patterns to provide them with pseudo angles in order to deal with the changes which occur to the angle of the sensor.

FIG. 12 shows the patterns of the electrostatic latent marks (W=169 μm (equivalent to four dots), which were formed so that their angle relative to the detection wire 2 become roughly zero. The laser driver 87 is fixed in resolution. Therefore, it cannot draw a line which is angled relative to the thrust direction of the drum 4. Therefore, each electrostatic latent mark is made up of multiple lines connected in the pattern of the cross-section of a stair case. As described above, the principle based on which the position of the electrostatic latent mark is detected is that there is a close relationship between the positional relationship between the amount by which electric current is induced in the detection wire 2 and the position of the electrostatic latent mark to be detected by the detection wire 2. That is, the smaller the angle between the detection wire 2 and the edge line of an electrostatic latent mark, the greater the amount by which electric current is induced in the detection wire 2.

The probability that the angle between the detection wire 2 and the edge line of an electrostatic latent mark will become virtually zero is proportional to the "length of time the entirety of the detection wire 2 is on an electrostatic latent mark". Shown in FIG. 12(*a*) is the idealistic pattern for an electrostatic latent mark, that is, the pattern of such an electrostatic latent mark that is zero degree in relative angle. In the case of the electrostatic latent mark in FIG. 12(*b*), it is two degrees in relative angle. Thus, if its length L is 2 mm, the length of time the entirety of the detection wire 2 is on an electrostatic latent mark is 2 mm×tan(2°)=70 μm, being therefore no more a half (41% (≈70÷169) of the length of time the entirety of the detection wire 2 is on an electrostatic latent mark when the relative angle is zero.

In comparison, if electrostatic latent marks are drawn so that they are made up of two sections which are 105.8 μm in length (equivalent to 25 dots) and are displaced from each other in the moving direction of the peripheral surface of the photosensitive drum 4 by 42 μm (equivalent to 1 dot) as shown in FIG. 12(*b*), the length of time the entirety of the detection wire 2 is on an electrostatic latent mark becomes roughly 80% (139÷169≈82%) of that when the relative angle is zero. If it is desired to draw an electrostatic latent mark, which is four degrees in the angle relative to the detection wire 2, all that is necessary is to draw an electrostatic latent mark made up of three sections which are 720 mm (equivalent to 17 dots) in length, and are positioned so that the second and third sections in terms of the thrust direction of the drum 4 are displaced in the moving direction (upstream or downstream) of the peripheral surface of the photosensitive drum 4 by 42 μm (equivalent to single dot) from the first and second sections, respectively, as shown in FIG. 12(*d*). Further, if it is desired to draw an electrostatic latent mark, which is four degrees in the angle relative to the detection wire 2, all that is necessary is to draw an electrostatic latent mark made up of four sections which are 508 mm (equivalent to 12 dots) in length, and are positioned so that the second, third, and fourth sections in terms of the thrust direction of the drum 4 are displaced in the moving direction (upstream or downstream) of the peripheral surface of the photosensitive drum 4 by 42 μm (equivalent to single dot) from the first, second, and third sections, respectively, as shown in FIG. 12(*e*).

These numerical values are for a case where the exposing device is 600 dpi in resolution; the photosensitive drum 4 is 140 mm/sec in peripheral velocity; the detection wire 2 is 2 mm in length, and 10 μm in width; and electrostatic latent marks are 169 μm (equivalent to 4 dots) in width. That is, the optimal value for the output is affected by the desired level of preciseness at which an image forming apparatus is to be corrected in color deviation, and the structure of the apparatus.

(Block Diagram of System for Comparing Detection Output)

Figure 9:
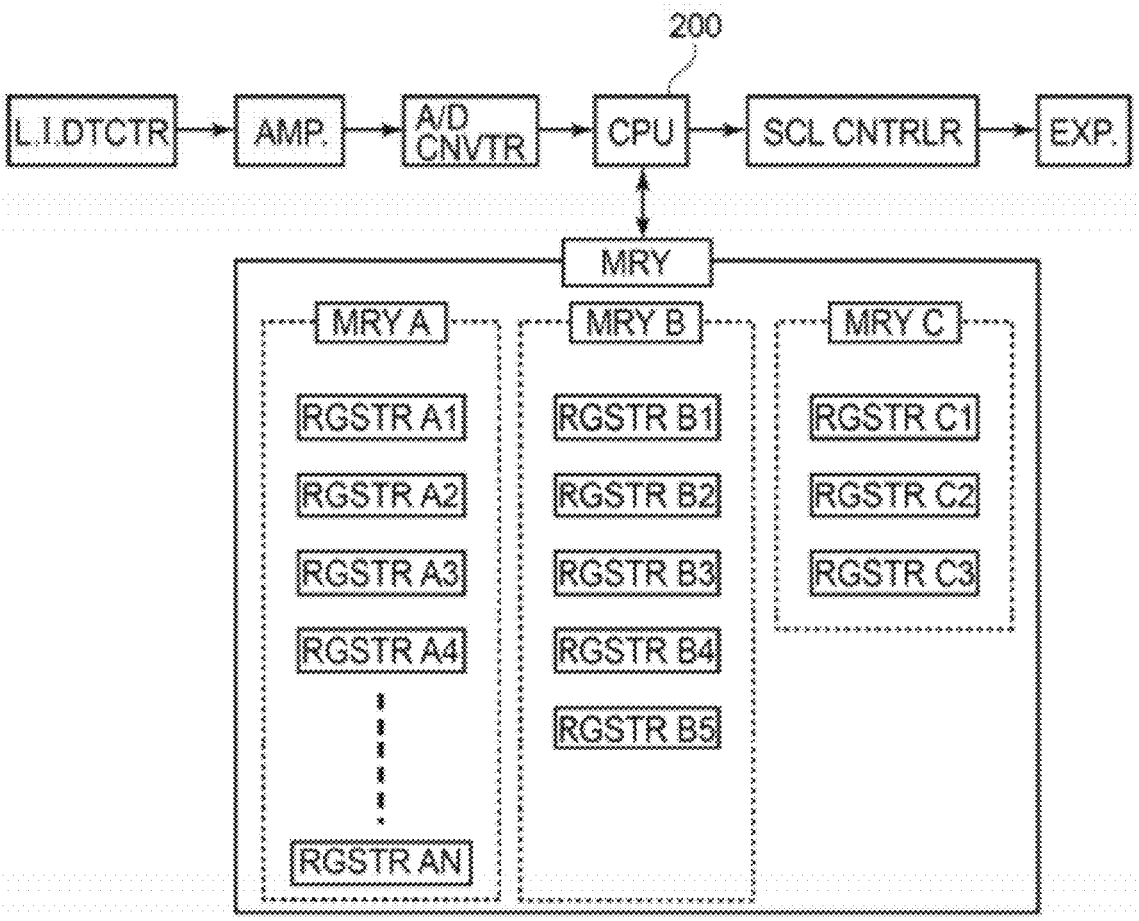
FIG. 9 is a block diagram of the color deviation reduction steps between when the electrostatic latent marks are detected and when new electrostatic latent marks are written on the image bearing member.

The block diagram of the system, in this embodiment, for selecting the optimal electrostatic latent mark is as shown in FIG. 9. First, multiple electrostatic latent marks which are different in pattern are detected by the latent image detecting section. The signals outputted by the latent image detecting section are amplified by the amplification circuit 5, converted into digital signals (A/D conversion), sent to the CPU, and stored in an A block of a memory section in the order of detection. In order to minimize the possible error in detection, it is desired to form (draw) multiple electrostatic latent marks for each pattern.

If four electrostatic latent marks, for example, are formed for each pattern, the value obtained by averaging the detection signal values stored in the registers A1-A4 of the memory block A is stored in the register B1 of the memory block B. Similarly, the value obtained by averaging the detection signal values stored in the registers A5-A8 of the memory block A is stored in the register B2 of the memory block B, and so on. The CPU compares in value the detection signals in the registers B1, B2, B3 and so on, and stores in the register C1 of the memory block C, the electrostatic latent mark pattern which made strongest the detection output in the latent image mark selection section. At the same time, the CPU stores the value of the output signal, which corresponds to this electrostatic latent mark pattern in the register C2 of the memory block C.

The register C3 is for storing the degree of tolerance (preset) for the difference between the idealistic value for the detection output and the value obtained by actual measurement (detection). Thus, when the CPU draws electrostatic latent marks, it reads the electrostatic latent mark pattern in the register C1 of the memory block C, and generates electrostatic latent marks having the pattern from the register C1, with the use of the electrostatic latent mark generation control section, and writes the electrostatic latent marks having the pattern from the register C1, on the peripheral surface of the photosensitive drum 4, with the use of the exposing section.

(Control Sequence for Correcting Image Forming Apparatus in Color Deviation, which Includes Timing with which Test Mode is to be Carried Out)

Figure 10:
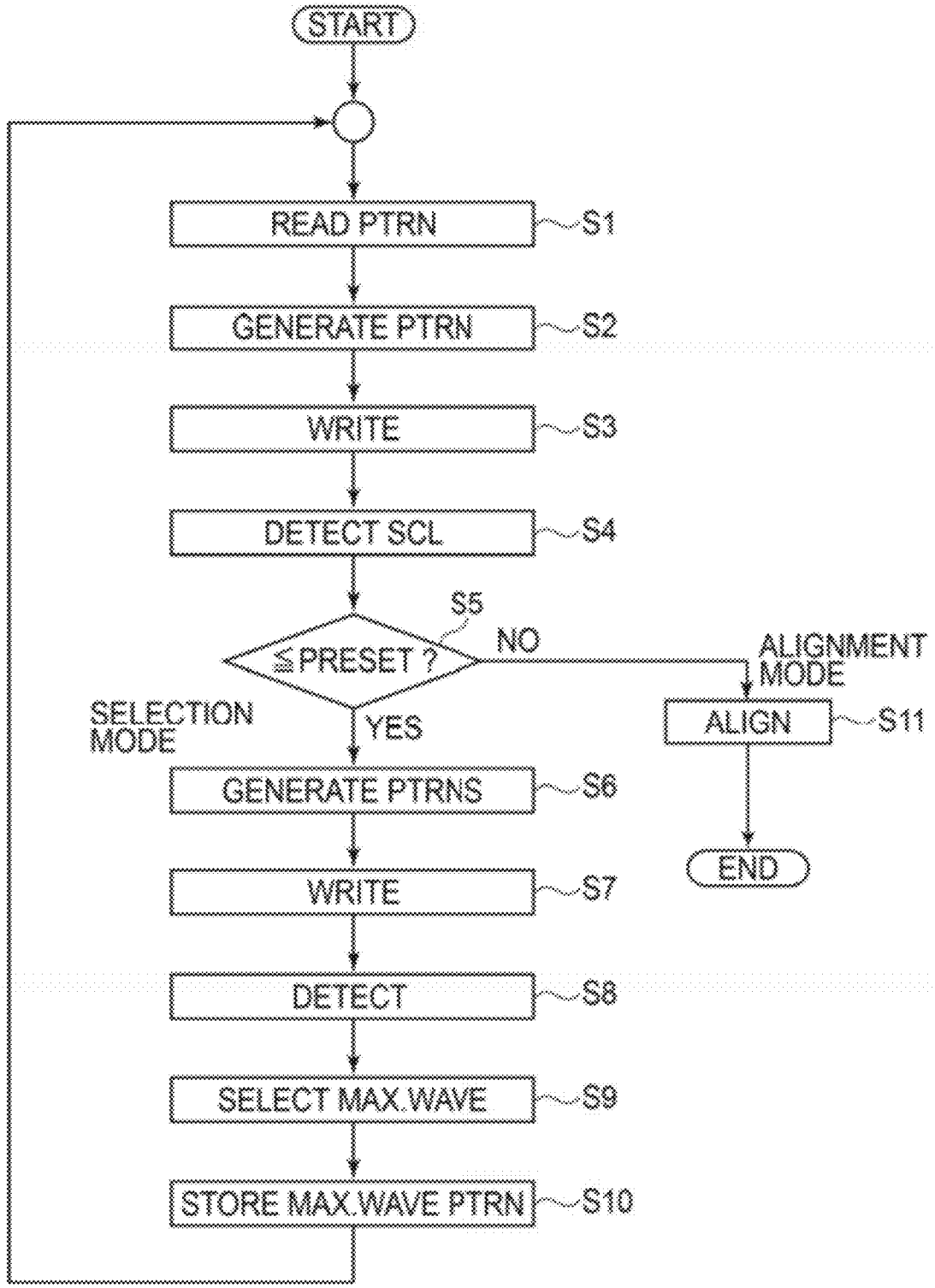
FIG. 10 is a flowchart of the operational sequence for optimizing the electrostatic latent mark sensor in output.

FIG. 10 is a flowchart of the control sequence, in this embodiment, for correcting the image forming apparatus in color deviation. The flowchart includes the timing with which the image forming apparatus is to be operated in the test mode.

1) Timing for Test Mode

The following three points in time can be considered as the timing for carrying out the control sequence which is for correcting the electrophotographic image forming apparatus in color deviation with the use of the electrostatic latent marks, and includes the test mode.

(a) Period between the starting of an image forming operation and the starting of the printing on the first sheet of recording medium;

(b) While the image forming apparatus is being idled; and (c) Period between when a finished print (sheet of recording medium to which four monochromatic developer images, different in color, have just been fixed) is discharged from the main assembly of the image forming apparatus, and when the image formation on the next sheet of recording medium is started.

In the case of the timings (a) and (c), the output value is checked each time an image is formed. In the case of timing (b), it is necessary to check the output value with a preset length of chronological interval according to the condition of the image forming apparatus, and the environment in which the apparatus is being used. As the control sequence for correcting the image forming apparatus in color deviation with the use of the electrostatic latent marks, first, the CPU reads the electrostatic latent mark pattern stored in the register C1 of the memory block C (S1), and generates the electrostatic latent mark pattern for exposure, with the use of the electrostatic latent mark generation control section (S2).

The exposing section exposes the peripheral surface of the photosensitive drum 4 in the generated electrostatic latent mark pattern; it writes electrostatic latent marks on the peripheral surface of the photosensitive drum 4 (S3). Then, the electrostatic latent mark detecting section (electrostatic image detecting section) detects the electrostatic latent marks on the peripheral surface of the photosensitive drum 4 (S4). The output of the electrostatic latent mark detecting section, which are analog signals, is sent to the CPU 200 (controlling device, executing device), through the A/D conversion section, that is, the amplification circuit shown in FIGS. 4 and 9, which converts an analog signal into a digital signal. Then, the CPU determines whether or not the output of the sensor 11 is less than the preset value (S5).

2) Electrostatic Latent Image Alignment Mode, and Electrostatic Latent Mark Selection Mode as Test Mode If the CPU determines that the output is less than the preset value, it places the image forming apparatus in the electrostatic latent mark selection mode as the test mode. On the other hand, if the CPU determines that the output is equal or more than the preset value, it places the image forming apparatus in the normal electrostatic latent image alignment mode. First, the electrostatic latent mark selection mode is described. As the CPU places the image forming apparatus in the electrostatic latent mark selection mode, it commands the latent electrostatic latent mark generation control section to generate multiple electrostatic latent mark patterns, and therefore, the exposing section exposes the peripheral surface of the photosensitive drum 4 so that multiple electrostatic latent marks which are different in pattern are written on the peripheral surface of the photosensitive drum 4 (S7).

Then, the electrostatic latent mark detecting section (electrostatic latent image detecting section) detects the multiple electrostatic latent marks different in pattern (S8), and the output of the electrostatic latent mark detecting section is sent to the A/D conversion section (which converts an analog signal into a digital signal) through the amplification circuit shown in FIGS. 4 and 9, and then, is sent to the CPU 200. The values of the outputs obtained by detecting the multiple electrostatic latent marks different in pattern are stored in the memory block B as described previously. Then, the CPU compares the values of the outputs stored in the registers B1, B2, B3 . . . , and selects the electrostatic latent mark having the pattern that makes the sensor 11 highest in output (S9). Then, the CPU stores the electrostatic latent mark pattern that makes the sensor 11 largest in output, in the memory block C1, and the corresponding signal strength value in the register C2 (S10).

As the image forming apparatus is operated in the electrostatic latent mark selection mode up to Step S10, the step S1 to the step S5 are repeated. If the value of the output is equal to, or larger than, the preset value, the electrostatic latent image alignment control sequence is carried out (S11). The image forming apparatus carries out a printing operation while carrying out the electrostatic latent image alignment control sequence, ending thereby the control sequence for correcting the image forming apparatus in color deviation.

In this embodiment, the number of the patterns in which multiple electrostatic latent marks are generated in the electrostatic latent mark selection mode is set to five (−4°, −2°, 0°, 2° and 4°) so that the image forming apparatus is placed in the electrostatic latent mark selection mode as the detection output falls below 90%. Shown in FIG. 14 is the values of the detection output when the electrostatic latent mark pattern was set to −4°, −2°, 0°, 2° and 4°, one for one, in the electrostatic latent mark selection mode in which the image forming apparatus was placed as the detection output became 83% during a printing operation when the relative angle was 0° (S5).

When the electrostatic latent mark which was −2° in relative angle is detected, the detection signal was 100% in strength, which is the initial strength. Therefore, the CPU selects "−2°" as the new electrostatic latent mark pattern, and stores "−2°" and 100% in the registers C1 and C2, respectively. In this embodiment, when the relative angle was −2°, the detection signal strength was 100%, or the initial strength. Therefore, "−2°" was selected as the new electrostatic latent mark pattern. However, even if the detection signal strength is less than 100% when an electrostatic latent mark with a given pattern is detected, the given pattern may be selected as the new electrostatic latent mark pattern as long as the selection does not affect the electrostatic latent image alignment control. For example, an electrostatic latent mark pattern which can make the sensor 11 no less than 90% (preset value) in output signal strength may be selected as the new electrostatic latent mark pattern. This value is affected by the resolution of the exposing system, sensitivity of the photosensitive drum 4, peripheral velocity of the photosensitive drum 4, detection wire size, etc.

The selection of the optimal electrostatic latent mark ends the electrostatic latent mark selection mode. Thus, the CPU places the image forming apparatus in the electrostatic latent image alignment mode, in which the CPU controls in rotational speed the downstream photosensitive drums 4 to reduce the sensors 11 and 10 in the detection errors which might occur when they detect the electrostatic latent marks on the photosensitive drum 4 and the electrostatic latent marks on the intermediary transfer belt 81, respectively. By controlling the downstream photosensitive drums 4 in rotational speed real-time during an image forming operation, it was possible to reduce the misalignment of the monochromatic developer images, different in color, to no more than 0.1 mm, preventing thereby the image forming apparatus from outputting images which suffer from color deviation.

(Electrophotographic Latent Marks on Intermediary Transfer Belt)

Although this embodiment was described with reference to the electrostatic latent marks on the photosensitive drum 4, it is needless to say that the image forming apparatus can be controlled in color deviation by transferring the electrostatic latent marks formed on the photosensitive drum 4 onto the intermediary transfer belt 81, and carrying out the control sequence for preventing the image forming apparatus from outputting images suffering from color deviation, with the use of the electrostatic latent marks on the intermediary transfer belt 81.

(Effects of this Embodiment)

When the sensors 11 and 10 are aligned (positioned) relative to the drum 4 and intermediary transfer belt 81, respectively, for the first time immediately while an image forming apparatus is assembled, the image forming apparatus may be operated in the test mode in this embodiment. Such a practice can make it unnecessary to realign (reposition) the sensor, and therefore, not only can it make the alignment (adjustment) mechanism simpler, but also, can automate the alignment (adjustment).

Further, an image forming apparatus may be equipped with a communication device so that the information about the color deviation prevention control sequence based on the detection of the electrostatic latent marks, information about the on-going printing operation, information about the performance of each component of the apparatus, and the like information can be continuously upload to a server to accumulate and analyze the information, and also, to maintain an image forming apparatus from a location away from the image forming apparatus.

[Embodiment 2]

Figure 13:
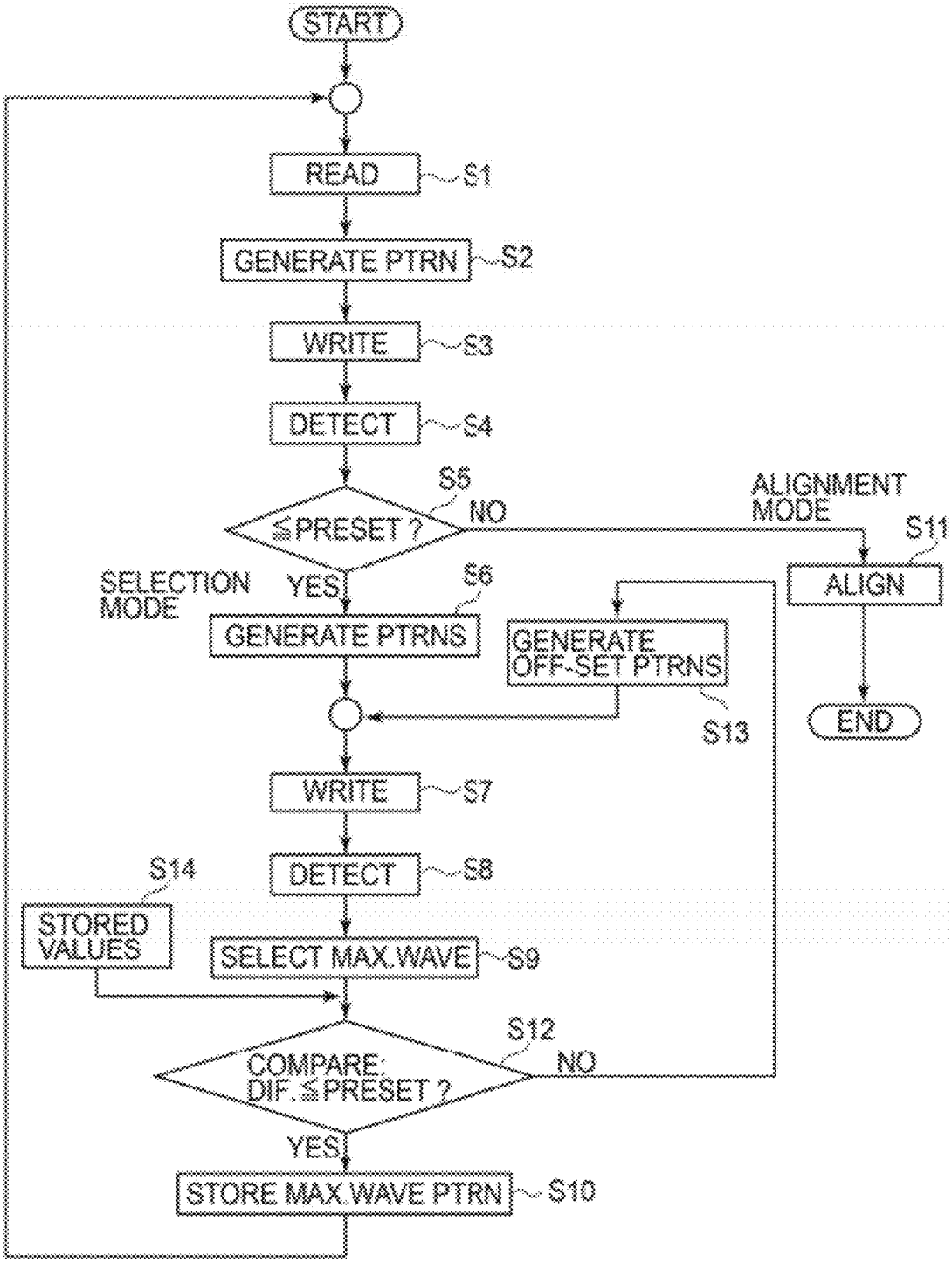
FIG. 13 is a flowchart of the routine for optimizing the latent mark sensor in output by repeating multiple times the routine for increasing the latent mark sensor in output.

In the first embodiment, the multiple patterns in which the electrostatic latent marks are formed in the test mode (electrostatic latent mark pattern selection mode) were preset. In this embodiment, however, an optimal electrostatic latent mark pattern is generated according to the results of the electrostatic latent mark detection. In other words, an optimally patterned electrostatic latent mark is detected, and therefore, the detection output is as strong as possible. FIG. 13 is a flowchart of the operational sequence which is for forming an optimally patterned electrostatic latent mark, and which includes the operational sequence in the selection mode. Also in this embodiment, the sequence can be carried out at the same point as one of the three points in the first embodiment. This flowchart has two more steps than that in the first embodiment:

(a) Comparison step in which the value of the stored signal strength is compared with the value of the strongest signal obtained by generating multiple electrostatic latent mark patterns (S12), (b) Pattern generation step which is carried out if the difference is below a preset value, and in which multiple electrostatic latent mark patterns which are different by a preset amount are generated (S13).

(Color Deviation Prevention Control Sequence)

Next, the color deviation prevention control sequence in this embodiment is described. The steps S1-S9 in this embodiment, which are carried out as the color deviation prevention control sequence based on electrostatic latent marks is started, are the same as the steps S1-S9 in the first embodiment (FIG. 10). In step S9, the values in the registers B1-B5 are read (S9), and the largest value among the values in the B1-B5 is compared with the signal strength value in the register C2 of the memory block C (S14) to determine whether or not the difference is no more than the preset amount of tolerance stored in the register C3 (S12). If the difference is within the preset amount of tolerance, the new electrostatic latent mark pattern and corresponding signal strength value are stored in the registers C1 and C2, respectively, as in the first embodiment (S10). Then, the CPU carries out the steps S1-S4. If the output value is more than the preset value, the CPU carries out the electrostatic latent image alignment control sequence (S11) and ends the printing operation.

If the difference is greater than the preset amount of tolerance, the CPU generates multiple electrostatic latent marks which are different in pattern by a preset angle from the multiple electrostatic latent marks having the initially generated patterns (S13). Whether the pattern is to be changed in the positive or negative direction is determined based on a principle that the change is to be made to increase the output in value. Then, the CPU generates multiple electrostatic latent mark patters different by a preset amount (angle) (S13), and then, carries out the steps S7-S9.

An image forming apparatus may be structured so that if the answer in S12 consecutively fails to become Yes because of the damage to the sensor (wire 2), a warning is issued to inform a user of the occurrence of an anomaly. In this embodiment, the number of the initial patterns in which electrostatic latent marks are formed in the electrostatic latent mark selection mode is set to only five (−4°, −2°, 0°, 2° and 4°), and the image forming apparatus was set up so that if the detection output falls below 90%, the image forming apparatus is placed in the electrostatic latent mark selection mode. Further, the value of the preset amount of tolerance, which is used for the comparison in step S12 was set to 15%. Further, the amount (angle) by which an electrostatic latent mark pattern in the multiple electrostatic latent mark patterns is made different from its closest electrostatic latent mark pattern was set to 2°.

Figure 15:
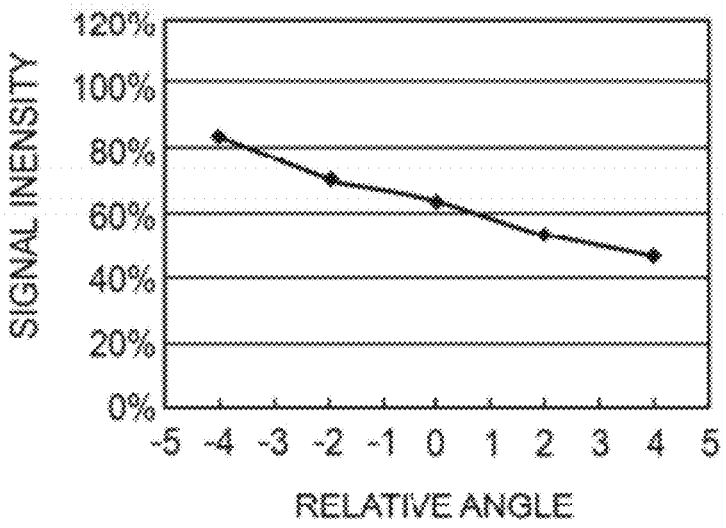
FIG. 15 is a graph which shows that the output of the latent mark sensor had no peak, and therefore, it was impossible to optimize the latent mark sensor in output by performing the routine only once.

While a printing operation was continued with the relative angle being zero, the output of the sensor fell to 62% (S5), and therefore, the image forming apparatus was placed in the electrostatic latent mark selection mode. The sensor outputs (S8) which corresponds to the multiple electrostatic latent mark patterns, the relative angle of which were −4°, −2°, 0°, 2° and 4°, one for one, are shown in FIG. 15. In FIG. 15, even when the relative angle was −4°, the output was 83%, which did not reach the tolerance limit of 15%. Therefore, the direction in which the new multiple electrostatic latent mark patterns are to be made different in angle from the preceding multiple electrostatic latent mark patterns is negative, as is evident from FIG. 15.

Figure 16:
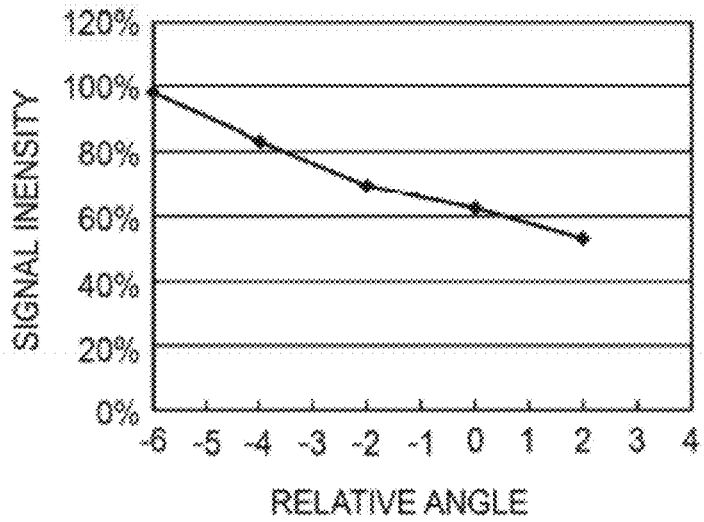
FIG. 16 is a graph which shows that it was twice that the routine had to be performed to optimize the latent mark sensor in output.

Shown in FIG. 16 are the relationship between the multiple electrostatic latent mark patterns which were generated in S13 and were −6°, −4°, −2°, 0° and 2°, one for one, (changed in negative direction by preset angle), and the strength of the outputs (signals) obtained through the step S7 and S8. In this case, the detection signal strength was 100% when the electrostatic latent mark which was −6° in relative angle was detected. Therefore, the CPU selected "−6°" as the relative angle for the new electrostatic latent mark pattern, and stored "−6°" and "100%" in the register C1 and C2, respectively (S10).

[Embodiment 3]

The first and second embodiments are related to the case in which the angle between the electrostatic latent mark and the electrostatic latent mark detection wire 2 deviated from the preset one. However, it is possible that the sensor (electrostatic latent mark detection wire 2) which is in contact with the peripheral surface of the photosensitive drum 4 will slightly shift in the rotational direction of the photosensitive drum 4. In this embodiment, the multiple sets of electrostatic latent marks, the electrostatic latent marks of which are different in the position relative to the electrostatic latent mark detection wire 2 (parallel to electrostatic latent mark), which is the means (electrostatic latent mark detection wire 2) for detecting the electrostatic latent marks, are formed.

Figure 17:
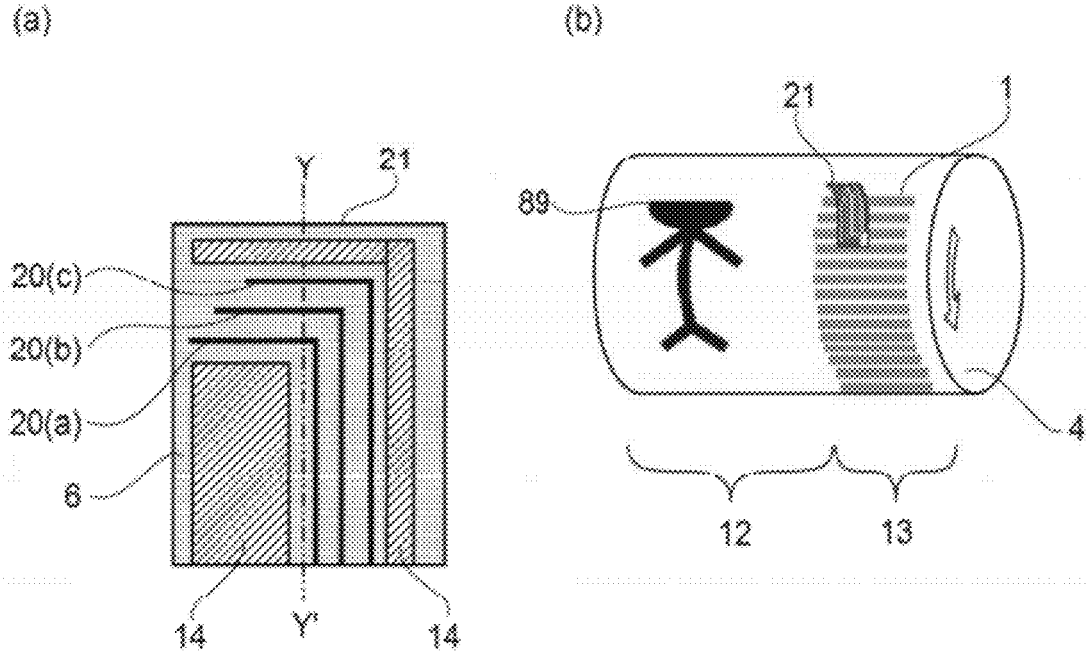
FIG. 17(*a*) is a schematic plan view of the latent mark detection sensor having multiple (three) detection wires which are different in position and are parallel to each other.

Shown in FIG. 17(*a*) is an electrostatic latent mark sensor 21 made up of three electrostatic latent mark detection wires 20(*a*), 20(*b*) and 20(*c*), the actual electrostatic latent mark detecting portions of which are parallel to each other and are perpendicular to the moving direction of the peripheral surface of the photosensitive drum 4. The electrostatic latent mark sensor 21 is positioned so that its electrostatic latent mark detecting portions of which become parallel to the electrostatic latent marks 1 as shown in FIG. 17(*b*).

Figure 18:
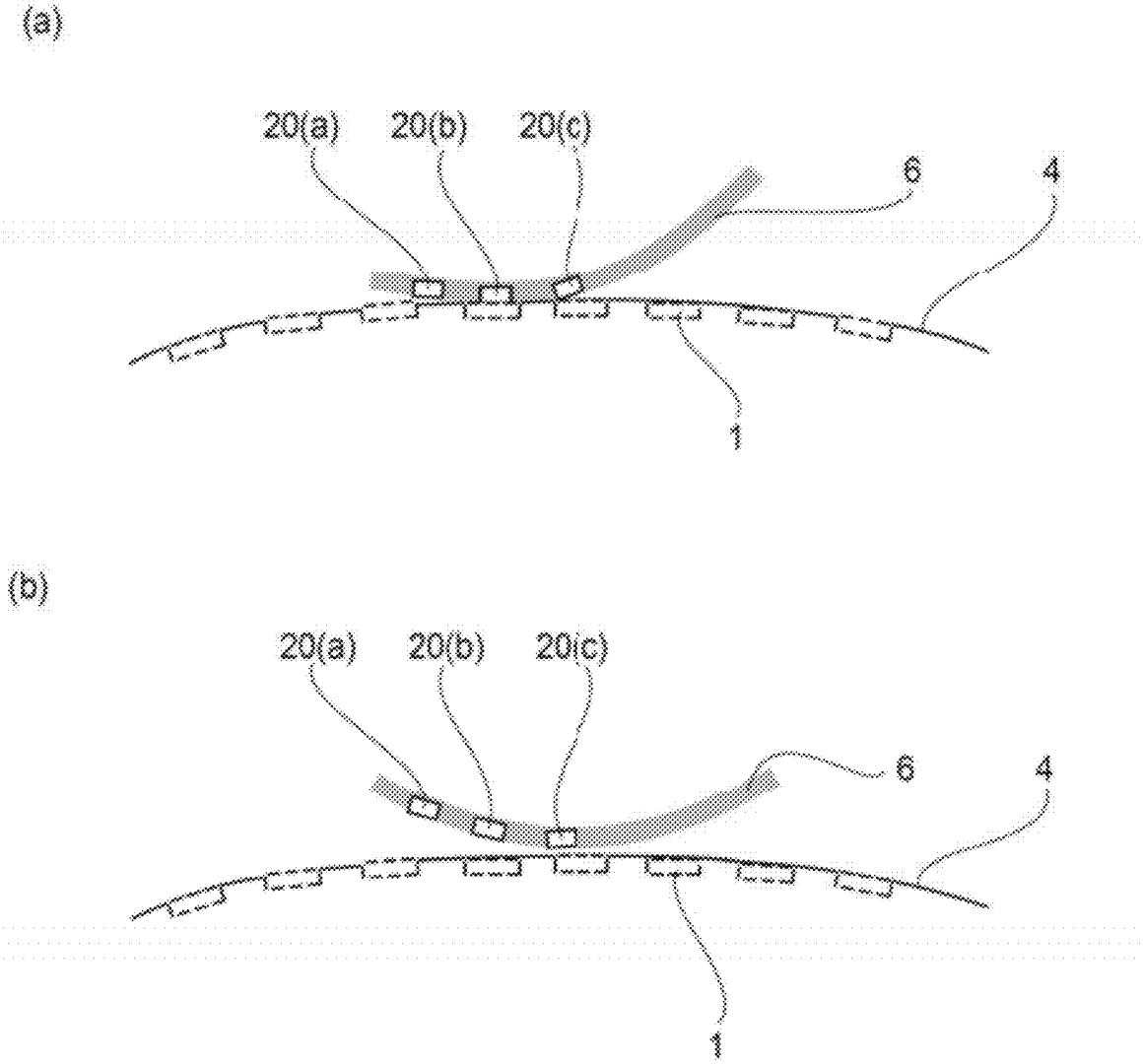
FIG. 18(*a*) is a sectional drawing of the latent mark sensor and the portion of the peripheral surface of the photosensitive drum 4 adjacent to the sensor, and shows that the latent image detection wire 20(*b*), which is in perfect alignment with one of the latent marks, was selected as the one which makes the sensor optimal in output.
Figure 19:
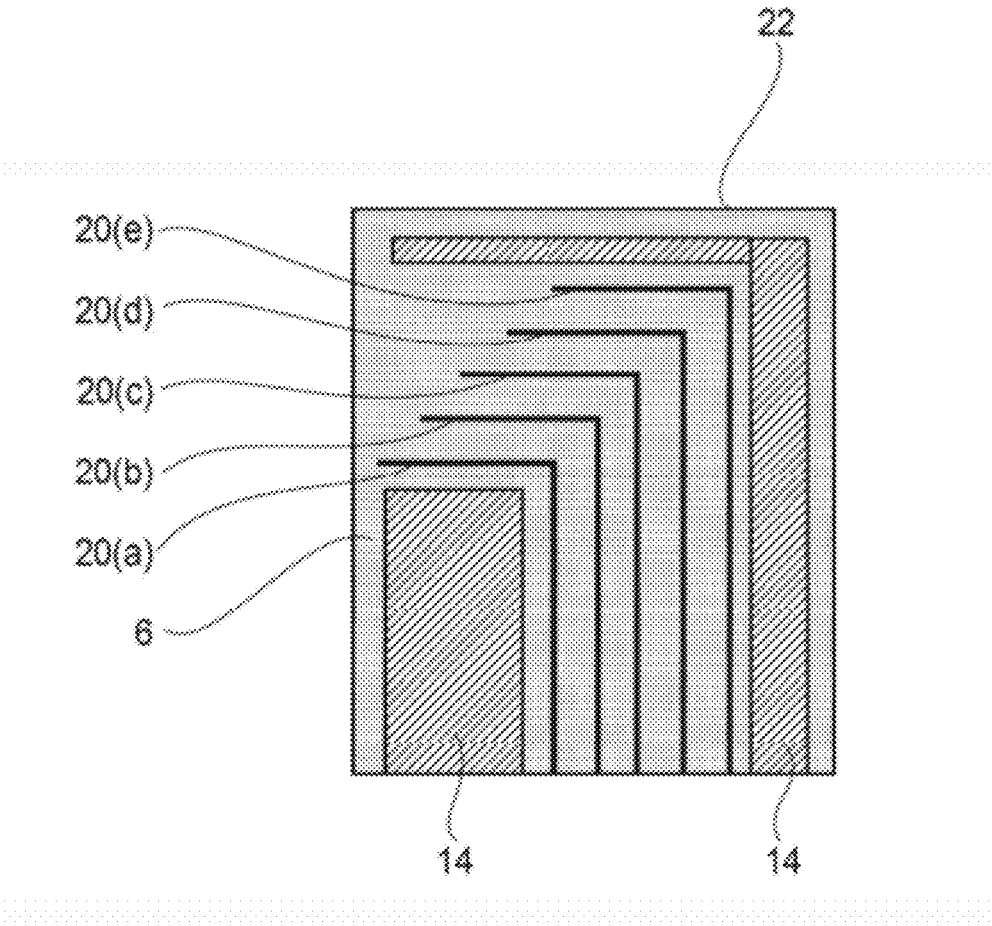
FIG. 19 is a schematic plan view of the latent mark sensor 6 having multiple detection wires which are different in position and are parallel to each other.

FIGS. 18(*a*) and 18(*b*) are sectional views of the electrostatic latent mark sensor at the plane Y-Y in FIG. 17, which is parallel to the moving direction of the peripheral surface of the image bearing member (ground 14 is not shown). FIG. 18(*a*) shows that the electrostatic latent marks 1 on the image bearing member 4 are being detected by the electrostatic latent mark detection wire 20(*b*) (electrostatic latent mark detection wires 20(*a*) and 20(*b*) are grounded). FIG. 18(*b*) shows that the electrostatic latent marks 1 on the image bearing member are being detected by the electrostatic latent mark detection wire 20(*c*) (electrostatic latent mark detection wires 20(*a*) and 20(*b*) are grounded). FIG. 19 shows an electrostatic latent mark sensor having five electrostatic latent mark detection wires 20(*a*)-20(*e*), which are parallel to each other. Incidentally, the interval between the adjacent two electrostatic latent mark detection wires and the number of electrostatic latent mark detection wires are optional.

In the test mode, the electrostatic latent marks on the image bearing member are detected by the multiple electrostatic latent mark detection wires of the electrostatic latent mark sensor, and the electrostatic latent mark-electrostatic latent mark detection wire combination which is strongest in output is selected. That is, if the electrostatic latent mark detection wire 20(*c*), for example, is selected, the electrostatic latent mark sensor is positioned so that the electrostatic latent marks on the image bearing members are detected by the electrostatic latent mark detection wire 20(*c*) during the following image formation mode.

(Block Diagram of Electrostatic Latent Mark Detection Wire Selection Sequence)

Figure 20:
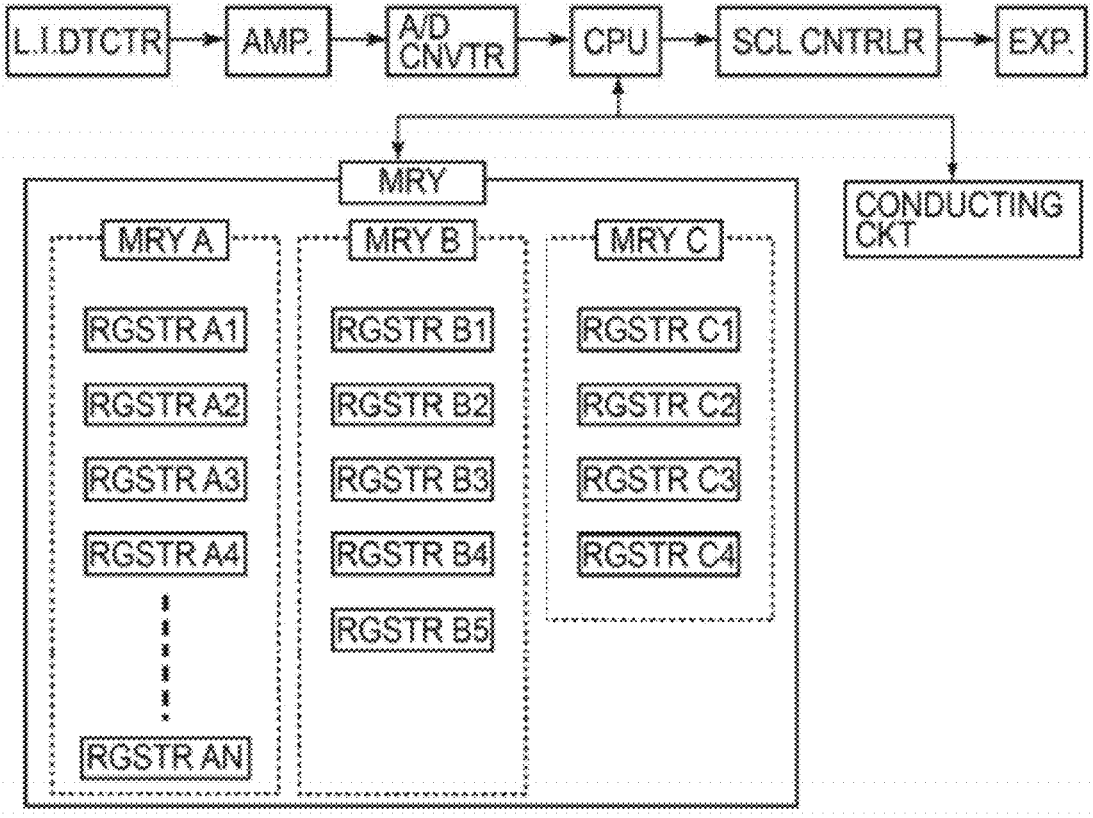
FIG. 20 is a block diagram of a color deviation reduction system equipped with a latent mark sensor having multiple detection wires positioned in parallel.

FIG. 20 is a block diagram of the system, in this embodiment, for selecting one of the parallelly positioned electrostatic latent mark detection wires as shown in FIGS. 18 and 19. The block diagram is the same in overall structure as the one shown in FIG. 9. Here, therefore, only the differences of the block diagram in FIG. 20 from that in FIG. 9 are primarily described. The electrostatic latent mark sensor (electrostatic latent mark detection wires) in this embodiment is strongest in output when it is in contact with the peripheral surface of the photosensitive drum 4. However, it outputs a small amount of electrostatic latent mark detection signals even when it is not in contact with the peripheral surface of the photosensitive drum 4. In other words, noise signals, that is, the signals which are not the desired electrostatic latent mark detection signals, are outputted, reducing thereby the electrostatic latent mark sensor in detection signal/noise ratio, unless a countermeasure or countermeasures are taken. Therefore, the electrostatic latent mark detection wires other than the one which is strongest in electrostatic latent mark detection signal are grounded with the use of a circuit for grounding the unnecessary electrostatic latent mark detection wires, in order to eliminate the noise.

(Control Sequence for Color Deviation Prevention)

Figure 21:
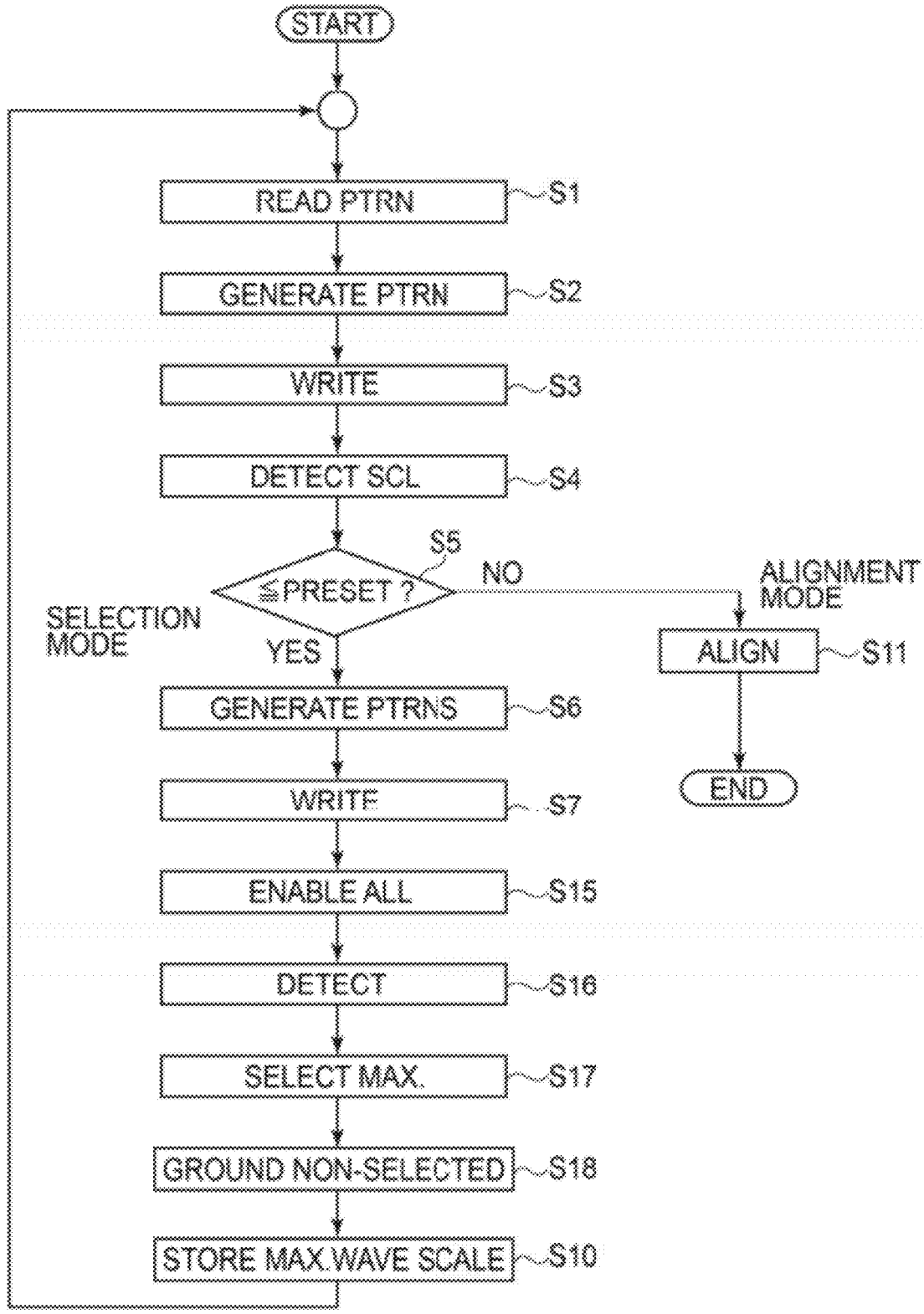
FIG. 21 is a flowchart of the operation (routine) for selecting the best detection wire, that is, the detection wire which is strongest in output signal.

FIG. 21 is a flowchart of the control sequence, in this embodiment, for preventing the image forming apparatus from outputting images which suffer from color deviation, with the use of the electrostatic latent mark sensor having multiple electrostatic latent mark detection wires which are parallelly positioned to each other. There are two differences between the flowchart shown in FIG. 21 and that shown in FIG. 10. The first is that the electrostatic latent marks in this embodiment are fixed in pattern. The second is that after the selection of the electrostatic latent mark detection wire which is strongest in detection signal, the electrostatic latent mark detection wires other than this wire are grounded as described above. Next, the flowchart in FIG. 21 is described, following the flow. The steps S1-S5 are the same as those in FIG. 10.

When the output of the electrostatic latent mark sensor is smaller than a preset value, the CPU places the image forming apparatus in the electrostatic latent mark wire section mode, in which patterns for an electrostatic latent mark which are the same as the conventional patterns are generated by the electrostatic latent mark formation control section (S6). Then, the exposing section writes electrostatic latent marks on the peripheral surface of the photosensitive drum by exposing the peripheral surface of the photosensitive drum 4 (and intermediary transfer belt 81) in the pattern generated by the electrostatic latent mark formation control section (S7). Before the reading of the electrostatic latent marks on the photosensitive drum by the electrostatic latent mark sensor, all the electrostatic latent mark detection wires are enabled to detect the electrostatic latent marks on the photosensitive drum (S15). Then, the electrostatic latent marks on the photosensitive drum are read by all the electrostatic latent mark detection wires of the electrostatic latent mark sensor (S16).

In the first embodiment, the CPU 200 stored in the register block B, the average value of the outputs of the electrostatic latent mark sensor, which correspond to the multiple electrostatic latent marks different in relative angle. In this embodiment, the CPU 200 stored in the register block B, the average value of the outputs of the electrostatic latent mark sensor which correspond to the multiple electrostatic latent mark detection wires, one for one. Then, the CPU 200 compares the values in the registers B1-B5, one for one, and selects the electrostatic latent mark detection wire which corresponds to the strongest detection signal (S17). After the selection of the electrostatic latent mark detection wire which is the strongest in detection signal, the CPU 200 grounds the other detection wires in order to prevent them from outputting detection signals (S18).

Then, the CPU 200 stores the identification of the electrostatic latent mark detection wire which is optimal (strongest) in detection signal, and its signal strength, in the registers C1 and C2, respectively (S10). As the steps S1-S10 in the electrostatic latent mark selection mode are carried out, the steps S1-S5 are repeated. If the output of the electrostatic latent mark sensor is equal to, or greater than, a preset value, a printing operation is started and continued while carrying out the electrostatic latent image alignment control sequence, ending thereby the control sequence for preventing the image forming apparatus from outputting images which suffer from color deviation.

[Embodiment 4]

Figure 22:
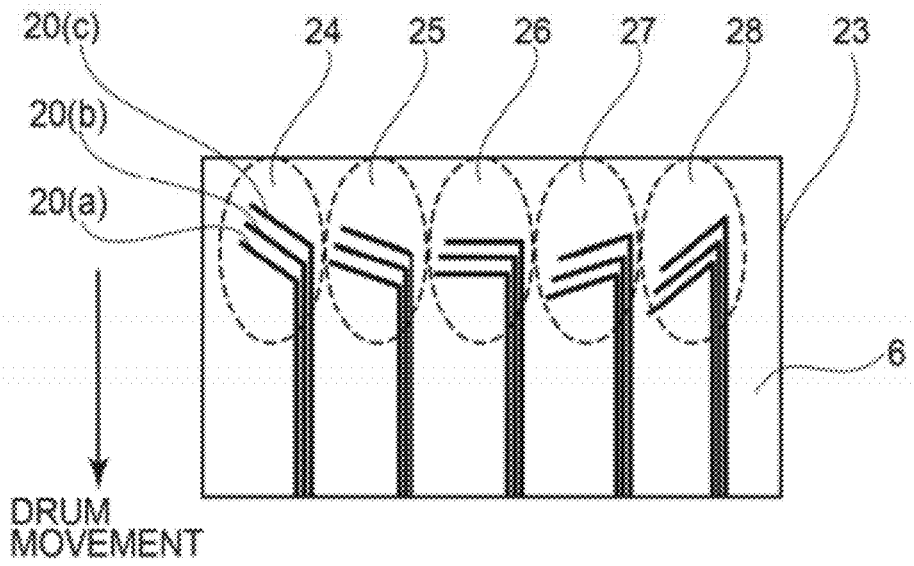
FIG. 22 is a schematic drawing of a latent mark sensor having multiple sets of detection wires, which are different in position, and also, in the wire angle relative to the moving direction of the peripheral surface of the image bearing member.
Figure 23:
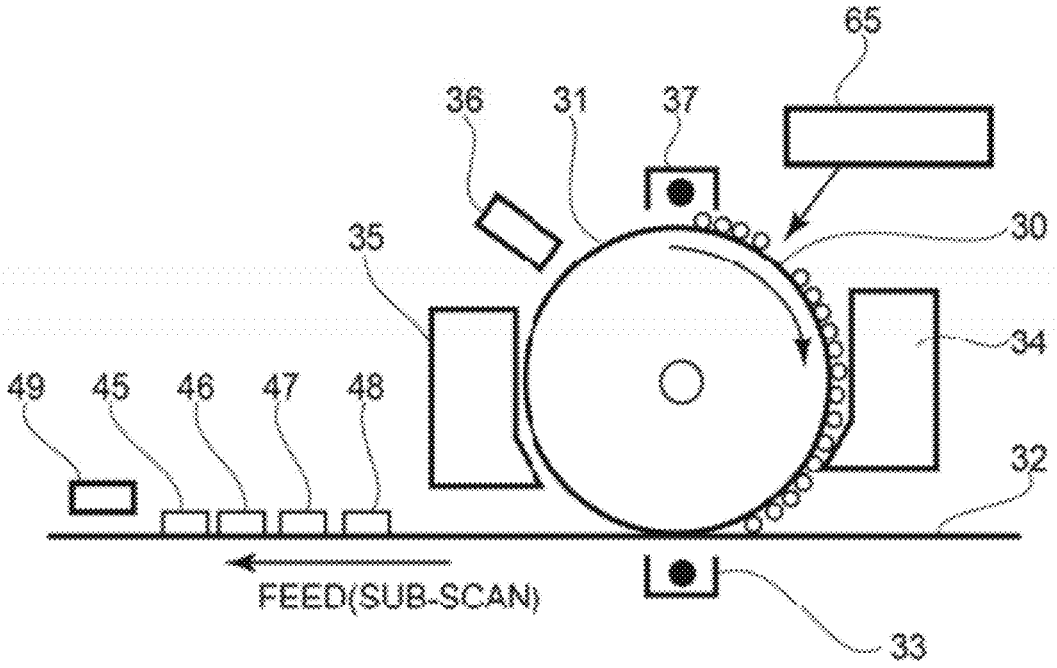
FIG. 23 is a schematic drawing for one of the conventional methods for detecting the changes in the output of the latent mark sensor in order to detect the position of the marks.

In this embodiment, the electrostatic latent image sensor is provided with multiple sets of detection wires (parallelly positioned as in third embodiment), which are different in detection wire angle. More concretely, referring to FIG. 22, the electrostatic latent mark sensor in this embodiment is provided with multiple (five) sets 24-28 of electrostatic latent mark detection wires. The five sets of electrostatic latent mark detection wires are different in the electrostatic latent mark detection wire angle. Each set has three electrostatic latent mark detection wires a, b and c. The electrostatic latent mark detection sets 24-28 are aligned in the direction perpendicular to the moving direction of the peripheral surface of the drum 4. The angle between the fixed electrostatic latent mark and the electrostatic latent mark sensor (electrostatic latent mark detection wires of electrostatic latent mark sensor) is minimized by selecting the electrostatic latent mark wire set which is strongest in output signal among the electrostatic latent mark wire sets 24-28. Further, the effects of the positional deviation of the electrostatic latent mark sensor in the moving direction of the peripheral surface of the photosensitive drum 4 is minimized (virtually cancelled) by selecting the electrostatic latent mark detection wire set which is strongest in electrostatic latent mark sensor output among the electrostatic latent mark detection wires a, b and c of the selected electrostatic latent mark wire set.

[Embodiment 5]

The color deviation prevention system in this embodiment is a combination of the third embodiment, the electrostatic latent mark sensor, in FIG. 17, having multiple (three) parallelly positioned electrostatic latent mark detection wires, and the multiple sets of electrostatic latent marks, in the first embodiment, which are different in electrostatic latent mark angle. That is, in this embodiment, it is not only a combination of one of the electrostatic latent mark pattern and electrostatic latent mark sensor (electrostatic latent mark detection wires) that is the subject of control. Instead, both the electrostatic latent mark pattern and electrostatic latent mark sensor (electrostatic latent mark detection wires) are the subjects of control. In this embodiment, therefore, the electrostatic latent mark pattern and electrostatic latent mark detection wire are stored in the registers C1 and C4 of the memory block C in the block diagram in FIG. 20. Therefore, it is possible to deal with both a case in which the electrostatic latent mark sensor become displaced without becoming askew relative to the rotational direction of the photosensitive drum 4, and a case in which the electrostatic latent mark sensor becomes askew, that is, the electrostatic latent mark sensor becomes tilted relative to the electrostatic latent marks.

As for the order of optimization, both a case in which the electrostatic latent mark is optimized in angle after the optimization of the electrostatic latent mark sensor, and a case in which the electrostatic latent image sensor is optimized after the optimization, in angle, of the electrostatic latent mark, are possible.

(Variation 1 of Preceding Embodiments)

In the preceding embodiments of the present invention, the first sets which are different in the positioning of the third electrostatic latent mark (which corresponds to first electrostatic latent mark (for drum) relative to the first detecting means (for drum) are formed in the test mode, and the first set which made the first detecting means highest in output was selected, or the second sets which are different in the positioning the fourth electrostatic latent mark (which corresponds to second electrostatic latent mark (for belt) relative to the second detecting means (for belt) are formed in the test mode. Then, the first set which made the first detecting means strongest in output, or second set which made the second detecting means strongest in output, was selected.

In addition to selecting the first set (for drum) or the second set (for belt) which made the first and second detecting means, respectively, strongest in output, it is possible to select the set which made both the first and second detecting means strongest in output. In such a case, selection has to be made among the second detecting means while keeping the second electrostatic marks fixed, because the second electrostatic latent mark (for belt) is commonly used by the downstream drums, unlike the first electrostatic latent marks (for drum).

(Variation 2 of Preceding Embodiments)

It is desired that the third marks (for drum), which are for the test mode, and/or the fourth marks (for belt), which are for the test mode, are formed outside the image formation area, like the first marks (for drum) and second marks (for belt). However, they may be formed within the image formation area in the test mode, and erased at the start of the image formation subsequent to the test mode. In such a case, the adjusted electrostatic latent marks are to be drawn on the area outside the image formation area before the starting of the image forming operation subsequent to the test mode.

(Variation 3 of Preceding Embodiments)

The preceding embodiments were described assuming that the member which moves in contact with each of the four drums is the intermediary transferring member. However, these embodiments are also compatible with an electrophotographic image forming apparatus which has a recording medium bearing member instead of the intermediary transferring member, that is, an electrostatic latent image forming apparatus structured so that toner images are sequentially transferred from its four image bearing members onto the sheet of recording medium (paper, for example) on the recording medium bearing member, and the images are layered on the recording medium; the toner image formed each drum is directly transferred onto the recording medium.

(Variation 4 of Preceding Embodiments)

In the preceding embodiments, it was when the output of the electrostatic latent mark sensor (electrostatic latent image detecting means) failed to exceed the preset value that the image forming apparatus was placed in the test mode. However, the image forming apparatus may be designed so that it is operated in the test mode with preset intervals.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 114804/2011 filed May 23, 2011, which is hereby incorporated by reference.

What is claimed is:

1. An image forming apparatus comprising:

a first image forming station including a first photosensitive member, a first electrostatic image forming device configured to form an electrostatic image on said first photosensitive member, and a first developing device configured to develop the electrostatic image on said first photosensitive member to form a first toner image with first color toner;

a second image forming station including a second photosensitive member, a second electrostatic image forming device configured to form an electrostatic image on said second photosensitive member, and a second developing device configured to develop the electrostatic image on said second photosensitive member to form a second toner image with second color toner of which color is different from color of the first color toner;

an intermediate transfer member configured to receive the first toner image from said first photosensitive member and the second toner image from said second photosensitive member sequentially in this order so as to superimpose the second toner image on the first toner image;

a first sensor including a first probe extended in a first direction and configured to detect a first index electrostatic image, on said intermediate transfer member, formed by said first electrostatic image forming device so that the first index electrostatic image is substantially parallel to the first direction and transferred from said first photosensitive member;

a second sensor including a second probe extended in a second direction and configured to detect a second index electrostatic image on said second photosensitive member formed by said second electrostatic image forming device so that the second index electrostatic image is substantially parallel to the second direction;

a controlling device configured to control a peripheral speed of said second photosensitive member so that the second index electrostatic image is superimposed on the first index electrostatic image at a transfer position where the second toner image is transferred from said second photosensitive member to said intermediate transfer member, in accordance with the detection result of said first sensor and the detection result of said second sensor; and an executing device configured to execute a test mode in which a first test index electrostatic image, which is inclined relative to the first direction by a predetermined nonzero angle, is formed on said first photosensitive member and then the first test index electrostatic image is transferred on said intermediate transfer member from said first photosensitive member and detected by said first sensor, and a second test index electrostatic image, which is inclined relative to the second direction by a predetermined nonzero angle, is formed on said second photosensitive member and then the second test index electrostatic image is detected by said second sensor;

wherein said controlling device controls an electrostatic image forming condition for the first index electrostatic image in accordance with the detection result of said first sensor in the test mode, and an electrostatic image forming condition for the second index electrostatic image in accordance with the detection result of said second sensor in the test mode.

2. An image forming apparatus according to claim 1, wherein said controlling device controls an angle of the first index electrostatic image relative to the first direction in accordance with the detection result of said first sensor in the test mode, and an angle of the second index electrostatic image relative to the second direction in accordance with the detection result of said second sensor in the test mode.

3. An image forming apparatus according to claim 1, wherein said controlling device controls the electrostatic image forming condition of the first index electrostatic image so that an output of said first sensor is larger than a predetermined value when the first index electrostatic image passes through said first sensor, and the electrostatic image forming condition of the second index electrostatic image so that an output of said second sensor is larger than a predetermined value when the second index electrostatic image passes through said second sensor.

4. An image forming apparatus according to claim 1, wherein said first electrostatic image forming device includes a first charging device configured to electrically charge said first photosensitive member and a first exposing device configured to expose said first photosensitive member which is charged by said first charging device, and said second electrostatic image forming device includes a second charging device configured to electrically charge said second photosensitive member and a second exposing device configured to expose said second photosensitive member which is charged by said second charging device, and wherein the electrostatic image forming condition of the first index electrostatic image is an exposing condition by said first exposing device, and the electrostatic image forming condition of the second index electrostatic image is an exposing condition by said second exposing device.

5. An image forming apparatus according to claim 1, wherein the first direction is substantially perpendicular to a moving direction of said intermediate transfer member, and the second direction is substantially perpendicular to a moving direction of said second photosensitive member.

6. An image forming apparatus according to claim 1, further comprising a plurality of second image forming stations to form a full color toner image.

7. An image forming apparatus according to claim 1, wherein said first sensor detects an induced electric current using said first probe, and said second sensor detects an induced electric current using said second probe.

8. A controlling method for an image forming apparatus including, a first image forming station including a first photosensitive member, a first electrostatic image forming device configured to form an electrostatic image on said first photosensitive member, and a first developing device configured to develop the electrostatic image on said first photosensitive member to form a first toner image with first color toner;

a second image forming station including a second photosensitive member, a second electrostatic image forming device configured to form an electrostatic image on said second photosensitive member, and a second developing device configured to develop the electrostatic image on said second photosensitive member to form a second toner image with second color toner of which color is different from color of the first color toner;

an intermediate transfer member configured to receive the first toner image from said first photosensitive member and the second toner image from said second photosensitive member sequentially in this order so as to superimpose the second toner image on the first toner image;

a first sensor including a first probe extended in a first direction and configured to detect a first index electrostatic image, on said intermediate transfer member, formed by said first electrostatic image forming device so that the first index electrostatic image is substantially parallel to the first direction and transferred from said first photosensitive member;

a second sensor including a second probe extended in a second direction and configured to detect a second index electrostatic image on said second photosensitive member formed by said second electrostatic image forming device so that the second index electrostatic image is substantially parallel to the second direction; and a controlling device configured to control a peripheral speed of said second photosensitive member so that the second index electrostatic image is superimposed on the first index electrostatic image at a transfer position where the second toner image is transferred from said second photosensitive member to said intermediate transfer member, in accordance with the detection result of said first sensor and the detection result of said second sensor, said controlling method comprising:

a first step of forming a first test index electrostatic image, on said first photosensitive member, which is inclined relative to the first direction by a predetermined nonzero angle;

a second step of transferring the first test index electrostatic image from said first photosensitive member to said intermediate transfer member;

a third step of detecting the first test index electrostatic image on said intermediate transfer member by said first sensor;

a fourth step of forming a second test index electrostatic image, on said second photosensitive member, which is inclined relative to the second direction by a predetermined nonzero angle;

a fifth step of detecting the second test index electrostatic image on said second photosensitive member by said second sensor; and a sixth step of controlling an electrostatic image forming condition for the first index electrostatic image in accordance with the detection result of said first sensor, and an electrostatic image forming condition for the second index electrostatic image in accordance with the detection result of said second sensor.

9. A controlling method according to claim 8, wherein in said sixth step, an angle of the first index electrostatic image relative to the first direction is controlled in accordance with the detection result of said first sensor in the test mode, and an angle of the second index electrostatic image relative to the second direction is controlled in accordance with the detection result of said second sensor in the test mode.

10. A controlling method according to claim 8, wherein said controlling device controls the electrostatic image forming condition for the first index electrostatic image so that an output of said first sensor when the first index electrostatic image passes through said first sensor is larger than a predetermined value, and the electrostatic image forming condition for the second index electrostatic image so that an output of said second sensor when the second index electrostatic image passes through said second sensor is larger than a predetermined value.

11. An image forming apparatus comprising:

a first image forming station including a first photosensitive member, a first electrostatic image forming device configured to form an electrostatic image on said first photosensitive member, and a first developing device configured to develop the electrostatic image on said first photosensitive member to form a first toner image with first color toner;

a second image forming station including a second photosensitive member, a second electrostatic image forming device configured to form an electrostatic image on said second photosensitive member, and a second developing device configured to develop the electrostatic image on said second photosensitive member to form a second toner image with second color toner of which color is different from color of the first color toner;

an intermediate transfer member configured to receive the first toner image from said first photosensitive member and the second toner image from said second photosensitive member sequentially in this order so as to superimpose the second toner image on the first toner image;

a first sensor including a first probe extended in a first direction and configured to detect a first index electrostatic image, on said intermediate transfer member, formed by said first electrostatic image forming device so that the first index electrostatic image is substantially parallel to the first direction and transferred from said first photosensitive member;

a second sensor including a second probe extended in a second direction and configured to detect a second index electrostatic image on said second photosensitive member formed by said second electrostatic image forming device so that the second index electrostatic image is substantially parallel to the second direction;

a controlling device configured to control a peripheral speed of said second photosensitive member so that the second index electrostatic image is superimposed on the first index electrostatic image at a transfer position where the second toner image is transferred from said second photosensitive member to said intermediate transfer member, in accordance with the detection result of said first sensor and the detection result of said second sensor; and an executing device configured to execute a test mode in which a first test index electrostatic image, which is inclined relative to the first direction by a predetermined nonzero angle, is formed on said first photosensitive member and then the first test index electrostatic image is transferred on said intermediate transfer member from said first photosensitive member and detected by said first sensor, wherein said controlling device controls an electrostatic image forming condition for the first index electrostatic image in accordance with the detection result of said first sensor in the test mode.

12. An image forming apparatus according to claim 11, wherein said controlling device controls an angle of the first index electrostatic image relative to the first direction in accordance with the detection result of said first sensor in the test mode.

13. An image forming apparatus according to claim 11, wherein said controlling device controls the electrostatic image forming condition of the first index electrostatic image so that an output of said first sensor is larger than a predetermined value when the first index electrostatic image passes through said first sensor.

14. An image forming apparatus according to claim 11, wherein the first direction is substantially perpendicular to a moving direction of said intermediate transfer member, and the second direction is substantially perpendicular to a moving direction of said second photosensitive member.

15. An image forming apparatus according to claim 11, wherein said first sensor detects an induced electric current using said first probe, and said second sensor detects an induced electric current using said second probe.

16. An image forming apparatus comprising:

a first image forming station including a first photosensitive member, a first electrostatic image forming device configured to form an electrostatic image on said first photosensitive member, and a first developing device configured to develop the electrostatic image on said first photosensitive member to form a first toner image with first color toner;

a second image forming station including a second photosensitive member, a second electrostatic image forming device configured to form an electrostatic image on said second photosensitive member, and a second developing device configured to develop the electrostatic image on said second photosensitive member to form a second toner image with second color toner of which color is different from color of the first color toner;

an intermediate transfer member configured to receive the first toner image from said first photosensitive member and the second toner image from said second photosensitive member sequentially in this order so as to superimpose the second toner image on the first toner image;

a first sensor including a first probe extended in a first direction and configured to detect a first index electrostatic image, on said intermediate transfer member, formed by said first electrostatic image forming device so that the first index electrostatic image is substantially parallel to the first direction and transferred from said first photosensitive member;

a second sensor including a second probe extended in a second direction and configured to detect a second index electrostatic image on said second photosensitive member formed by said second electrostatic image forming device so that the second index electrostatic image is substantially parallel to the second direction;

a controlling device configured to control a peripheral speed of said second photosensitive member so that the second index electrostatic image is superimposed on the first index electrostatic image at a transfer position where the second toner image is transferred from said second photosensitive member to said intermediate transfer member, in accordance with the detection result of said first sensor and the detection result of said second sensor; and an executing device configured to execute a test mode in which a second test index electrostatic image, which is inclined relative to the second direction by a predetermined nonzero angle, is formed on said second photosensitive member and then the second test index electrostatic image is detected by said second sensor, wherein said controlling device controls an electrostatic image forming condition for the second index electrostatic image in accordance with the detection result of said second sensor in the test mode.

17. An image forming apparatus according to claim 16, wherein said controlling device controls an angle of the second index electrostatic image relative to the second direction in accordance with the detection result of said second sensor in the test mode.

18. An image forming apparatus according to claim 16, wherein said controlling device controls the electrostatic image forming condition of the second index electrostatic image so that an output of said second sensor is larger than a predetermined value when the second index electrostatic image passes through said second sensor.

19. An image forming apparatus according to claim 16, wherein the first direction is substantially perpendicular to a moving direction of said intermediate transfer member, and the second direction is substantially perpendicular to a moving direction of said second photosensitive member.

* * * * *